US005243395A

United States Patent [19]

Koike et al.

[11] Patent Number: 5,243,395

[45] Date of Patent: Sep. 7, 1993

[54] COLOR IMAGE FORMING APPARATUS WITH DEVELOPING UNIT MOVING MEANS

[75] Inventors: Michiro Koike, Kawasaki; Masaki Nakaoka; Tadayuki Kitajima, both of Yokohama, all of Japan

[73] Assignee: Canon Kabushiki Kaisha, Tokyo, Japan

[21] Appl. No.: 474,369

[22] Filed: Feb. 2, 1990

[30] Foreign Application Priority Data

| | | | |
|---|---|---|---|
| Feb. 3, 1989 | [JP] | Japan | 1-026297 |
| Feb. 3, 1989 | [JP] | Japan | 1-026298 |
| Feb. 28, 1989 | [JP] | Japan | 1-047586 |
| May 16, 1989 | [JP] | Japan | 1-121898 |

[51] Int. Cl.[5] ..... G03G 15/01

[52] U.S. Cl. ..... 355/327; 355/277

[58] Field of Search ..... 355/245, 277, 274, 317, 355/326, 327, 271, 208, 246

[56] References Cited

U.S. PATENT DOCUMENTS

| | | | |
|---|---|---|---|
| 3,399,610 | 9/1968 | Eichorn | 355/317 |
| 3,645,617 | 2/1972 | Pollock | 355/326 |
| 3,981,576 | 9/1976 | Inoue | 355/327 |
| 4,095,879 | 6/1978 | Katayama et al. | 355/326 |
| 4,622,916 | 11/1986 | Tanaka et al. | 118/688 |
| 4,728,983 | 3/1988 | Zwadlo et al. | 355/326 X |
| 4,841,336 | 6/1989 | Kusumoto et al. | 355/326 X |
| 4,894,684 | 1/1990 | Nakajima et al. | 355/326 X |
| 4,910,535 | 3/1990 | Yoshino et al. | 355/327 X |
| 5,111,245 | 5/1992 | DeCecca et al. | 355/245 |

FOREIGN PATENT DOCUMENTS

| | | |
|---|---|---|
| 0226213 | 6/1987 | European Pat. Off. . |
| 0266946 | 5/1988 | European Pat. Off. . |
| 0339309 | 11/1989 | European Pat. Off. . |
| 2060163 | 4/1971 | Fed. Rep. of Germany . |

*Primary Examiner*—Leo P. Picard
*Assistant Examiner*—Christopher Horgan
*Attorney, Agent, or Firm*—Fitzpatrick, Cella, Harper & Scinto

[57] ABSTRACT

An image forming apparatus having a carriage carrying plural developing units is movable along a rectilinear predetermined path to provide a desired developing unit adjacent a photosensitive member of the image forming apparatus. The developing unit is moved to a developing position by moving the unit in a direction perpendicular to the direction of the carriage movement using the moving force used for moving the carriage.

23 Claims, 18 Drawing Sheets

COLOR IMAGE FORMING APPARATUS WITH DEVELOPING UNIT MOVING MEANS

FIELD OF THE INVENTION AND RELATED ART

The present invention relates to a multi-color image forming apparatus such as a color copying machine or a color printer of an electrophotographic or electrostatic recording type provided with plural developing units containing different color developers.

Recently, various types of multi-color image forming apparatuses are proposed. FIG. 1 shows a typical example of a color copying machine of an electrophotographic type.

In such an apparatus, an electrophotographic photosensitive member (photosensitive drum) 1 in the form of a drum (image bearing member) is uniformly charged by a primary charger 4 and is exposed to color-separated light image of an original 27 to be copied through optical means including illuminating means 25, a lens 22, mirrors 24, 23 and 21 and a color separation filter 20. By the exposure, a latent image is formed on the photosensitive drum 1 corresponding to the color separation. A rotary developing apparatus is disposed adjacent to the photosensitive drum 1 and comprises a yellow developing unit 2Y, a magenta developing unit 2M, a cyan developing unit 2C and a black developing unit 2B, and a turret 3 on which the developing units are supported. Such one of the developing units as corresponds to the color separation latent image is brought to the developing position to develop the latent image into a toner image. The toner images on the photosensitive drum are superposedly transferred onto a transfer material supported on a transfer material drum 6 disposed below the photosensitive drum 1. The transfer material is supplied from one of the cassettes 15 and 16 by an associated one of the pick-up rollers 13 or 14. The transfer material is fed to the transfer drum 6 by a registration roller 12 in timed relation with the toner image on the photosensitive drum 1, and is gripped by gripper means 10 of the transfer drum so that it is supported on the transfer drum 6.

The transfer material onto which the toner image has been transferred is separated from the transfer drum by a separation charger 8 or the like and is discharged to a tray 19 through a conveying section 17 and an image fixing device 18. The toner image remaining on the photosensitive drum is removed by a cleaner 5 from the photosensitive drum after the image is transferred and is prepared for the next image forming operation. Such an apparatus is disclosed in U.S. Pat. No. 4,622,916, for example.

Another type of image forming apparatus is known, as disclosed in U.S. Pat. No. 4,095,879, for example, wherein plural developing units are disposed opposed to the peripheral surface of the photosensitive drum. The latter type has the advantages that any developing unit can be easily driven when the developing operation is not performed and that the developer can be stirred at any time, and the advantages are not easily provided in the former type. On the contrary, the peripheral length of the image bearing member (photosensitive drum) is required to be long, with the result that the image forming apparatus becomes bulky and complicated. In addition, the latter type developing apparatus involves the disadvantage that the distances between the image exposure position of the image bearing member and the individual developing units are different, so that the dark decay of the charge of the image bearing member is a significant problem. In order to avoid the disadvantages, the image forming process is complicated, and the high quality image is not stably produced.

The former type does not involve the disadvantages of the latter type, but it requires that the developing units 2Y–2B supported on the turret 3 is conveyed to the developing position (where it is opposed to the photosensitive drum 1) by rotating the turret, with the result of significant space being required for the rotary developing device within the copying machine.

Japanese Laid-Open Patent Application No. 27548/1975 and U.S. Pat. No. 3,981,576 disclose an apparatus wherein plural developing units are mounted on a single table which is laterally movable to present a selected one of the developing units to the image bearing member. This type is advantageous because the disadvantages of the above discussed two types do not arise. However, further improvement is desired.

SUMMARY OF THE INVENTION

Accordingly, it is a principal object of the present invention to provide an image forming apparatus capable of forming an image in at least two colors or a full color image.

It is another object of the present invention to provide an image forming apparatus in which the size thereof can be reduced and which is capable of forming an image in at least two colors or a full color image.

It is a further object of the present invention to provide an image forming apparatus wherein plural developing units are supported on supporting means which is linearly movable.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 2:
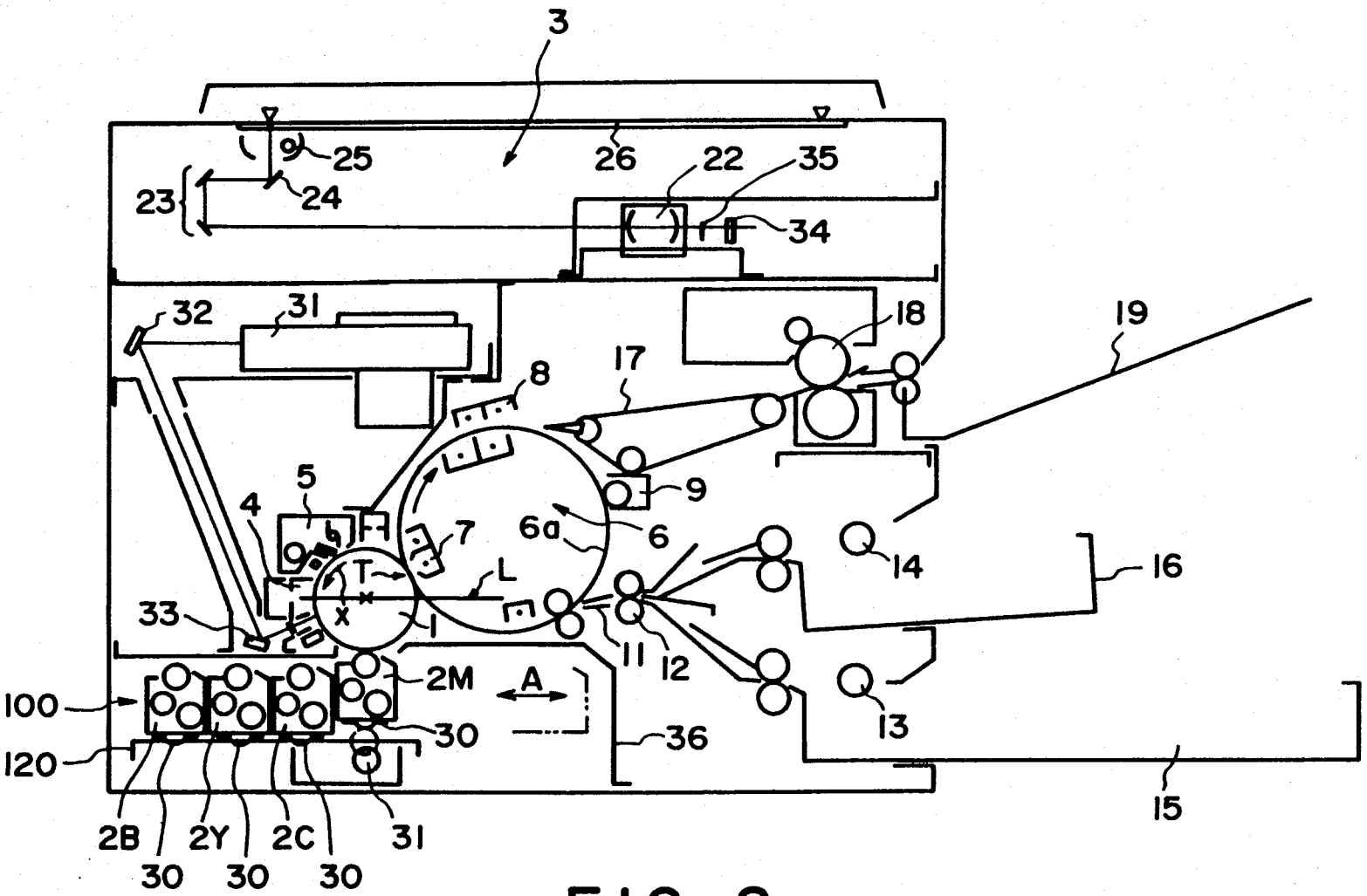
FIG. 2 is a sectional view of an image forming apparatus according to an embodiment of the present invention.

Referring to FIG. 2, there is shown a full-color electrophotographic copying apparatus which is an exemplary image forming apparatus according to an embodiment of the present invention. An image bearing member which is in the form of a photosensitive drum in this embodiment is provided with a surface electrophotographic photosensitive layer and is rotatable in a direction indicated by an arrow x. At the left side of the photosensitive drum 1, there are disposed a primary charger 4; at the bottom of the photosensitive drum 1, there is disposed a developing device 100 containing a plurality of developing units, more particularly, the developing units 2M, 2C, 2Y and 2B in this embodiment which are rectilinearly movable in a direction of arrow A. Adjacent an upper right position of the photosensitive drum 1, there is disposed an image transfer device 6; and adjacent the upper left portion of the photosensitive drum 1, a cleaning device 5 is disposed.

Above the top of the copying machine, an optical system 3 is disposed to project an image of an original on the platen 26 onto the photosensitive drum 1. The optical system 3 may be of any known type, and in this embodiment, it comprises a first scanning mirror 24, second and third scanning mirrors 23 movable in the same direction and at a speed, one half that of the first scanning mirror 24, an imaging lens 22, color separation filters 35 for blue, green and red, CCD (charge coupled device) 34, a laser scanner unit 31 and fixed mirrors 32 and 33. The scanner unit 31 may be of a known type which deflects a laser beam by a polygonal mirror, and therefore, the detailed description thereof is omitted.

In the optical system 3, the original illuminating light source 25 moves together with the first scanning mirror 24. Therefore, the image light reflected by the original scanned by the first, second and third mirrors 24 and 23 is passed through the lens 23, and is color-separated and is converted to an electric signal by the color separation filter (blue, green and red) 35 and the CCD 34. The signal indicative of the information of the original is processed for A/D conversion or the like, and then, is transmitted as a video signal to a microprocessor which will hereinafter be called "MPU" for controlling the entire copying machine. The MPU, responsive to the signal, instructs to oscillate a laser beam from a laser unit through a laser driver, the laser beam being modulated. The laser beam scans the photosensitive drum 1 which has been electrically charged by the charger 4, by which an electrostatic latent image is formed thereon.

In this embodiment, an image fixing device 18 and sheet feeding devices 15 and 16 are disposed at the right portion of the copying machine, and between the transfer drum 6 and the fixing device 18, a transfer sheet conveying system 17 is disposed.

With this structure, the photosensitive drum 1 is subjected to the charging, exposing, developing, image-transferring and cleaning processes by the primary charger 4, the optical system 3, the developing device 100, the image transferring device 6 and the cleaning device 5, for each of the colors.

The developing device 100, which will be described more in detail hereinafter is provided with a developing unit 2M containing a magenta toner, a developing unit 2C containing a cyan toner, a developing unit 2Y containing yellow toner and a developing unit 2B containing black toner, which are detachably mounted on a movable base carriage 120. The developing device 100 functions to visualize into toner images the color-separated latent images on the photosensitive drum by corresponding developing units.

The transfer device 6 is typically provided with a transfer material carrying sheet 6*a* at its peripheral, and the transfer material or sheet is electrostatically retained on the sheet. The transfer device 6 is in the form of a transfer drum. The transfer drum 6 rotates and grips the transfer sheet fed from the sheet feeding devices 15 and 16 in timed relation and conveys it so that the toner images in the respective colors are superposedly transferred from the photosensitive drum 1 at the image transfer station T. At the transfer station T, an image transfer charger 7 is disposed inside the transfer drum 6.

The transfer sheet to which the toner images in various colors are gradually transferred, is released from the transfer drum 6, and is separated from the transfer drum 6 by a separation charger 8 or the like. Subsequently, the transfer sheet is conveyed to the fixing device 18 by the transfer sheet conveying system 17. The toner image is fixed on the transfer sheet by the fixing device 18, and then, the transfer sheet is discharged to the tray 19.

As will be understood from the foregoing explanation in conjunction with FIG. 2, the transfer position T where the toner image formed on the photosensitive drum 1 is transferred onto the transfer sheet retained on the transfer drum 6 is above a horizontal line L passing through the center of the photosensitive drum 1, and the developing units 2M, 2C, 2Y and 2B of the developing device 100 are disposed below the photosensitive drum 1.

With this structure, even if the developer is leaked from the developing device 100 and scattered within the apparatus, the possibility of the scattered developer being deposited on the surface of the transfer drum or the transfer sheet disposed thereabove is extremely reduced. In addition, since the developing device 100 is disposed at a lower position of the main frame of the copying apparatus, it is possible that the developing region is enclosed with a cover 36 or the like to enclose the developer in the developing region to prevent the scattering of the toner to the region of the transfer drum.

Since the image transfer position T is above the horizontal line L passing through the center of the photosensitive drum 1, the likelihood that the developer deposited on the photosensitive drum 1 will scatter and fall toward the photosensitive drum 6 to contaminate it is reduced. In addition, since the cleaner 5 is disposed at the side of the transfer drum 1, the likelihood that the developer scattered by the cleaner 5 will be deposited on the surface of the transfer drum 6 is significantly reduced.

According to an aspect of the embodiment, the developing units 2M-2B of the developing device 100 are mounted on a movable carriage 120 which is horizontally moved by a stepping motor or the like so that a selected one of the developing units is moved to a predetermined position which is substantially right below the photosensitive drum. Then, rotatable cam means 31 is engaged to an engaging member 30 mounted to the bottom of the developing unit, by which the selected developing unit is raised to a developing position by the cam means 31. The position is maintained until the developing operation by the selected unit is completed. After the completion of the developing operation, the developing unit is lowered, and the carriage 120 is horizontally moved. Subsequently, the next selected developing unit is presented to the developing position, and the developing operation is performed similarly.

Figure 1:
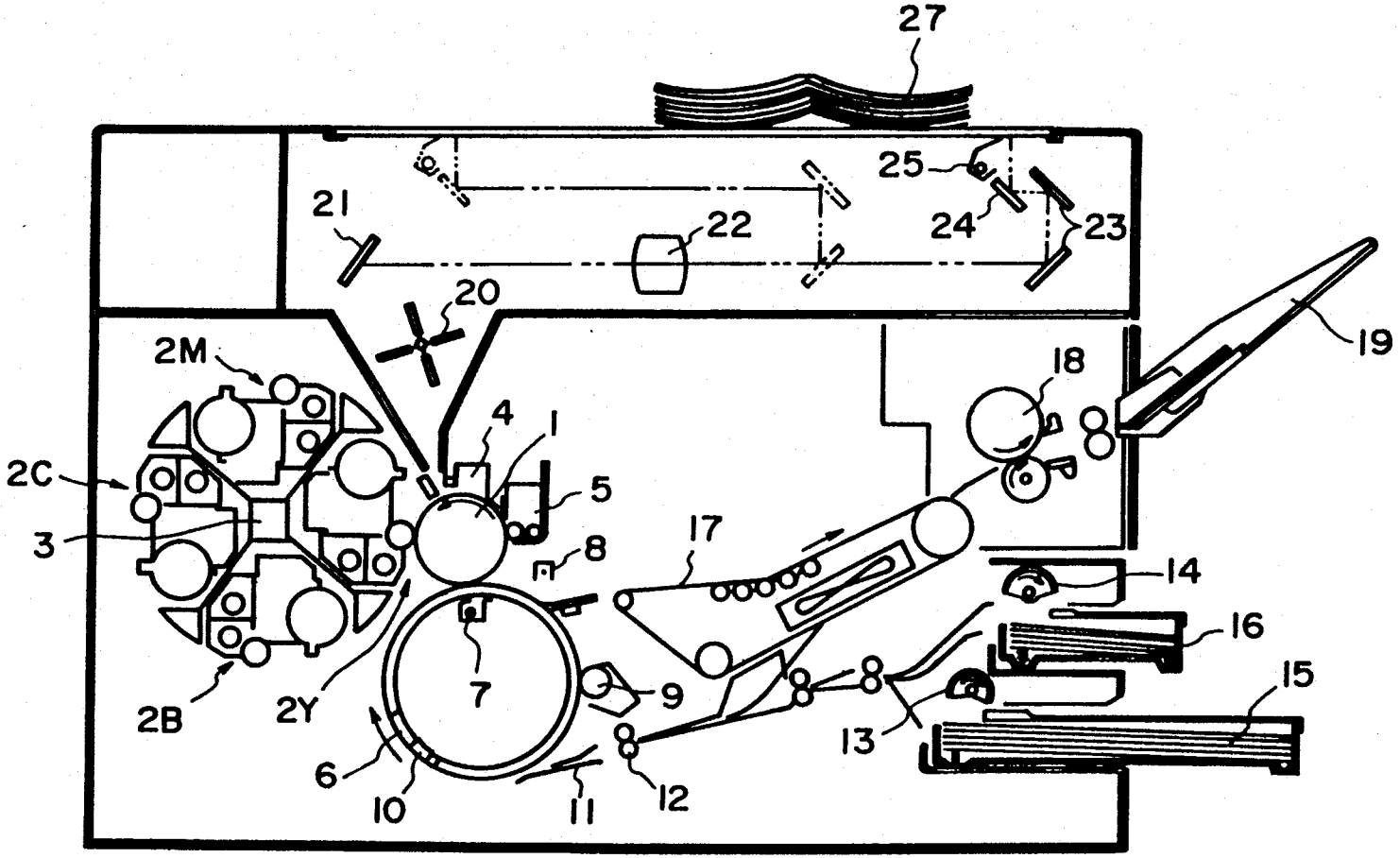
FIG. 1 PRIOR ART
FIG. 1 is a sectional view of a conventional image forming apparatus.

The structure and the driving control of the developing apparatus, as compared with the conventional rotary developing device shown in FIG. 1, can be accommodated in a smaller space, so that the size of the copying machine can be reduced, and in addition, the developing unit may be moved or exchanged at higher speed.

More particularly, when a transfer drum having a diameter of 150 mm is used, it has been extremely difficult with the conventional rotary developing device to perform the image forming operation while the transfer drum carries two A4 size sheets laterally, because the exchange of the developing units require significant time. However, according to the structure of the present invention, this can be very easily accomplished. This means that when the image processing speed is the same, the productivity is doubled.

In this embodiment, the present invention is applied to a digital full-color electrophotographic copying machine wherein an image of the original is once converted to electric signals, but the present invention is applicable to a color printer without the original reading mechanism, for example, the printer using image signals from a computer or the like, to a color copying machine wherein the original is directly projected on the photosensitive drum without being converted to electrical signals, and to an image forming apparatus of an electrostatic recording type.

It is possible that the toner image on the photosensitive drum is not transferred to the transfer sheet, but is sequentially and superposedly transferred onto a so-called intermediate transfer material, and finally they are transferred onto a sheet or the like.

Figure 3:
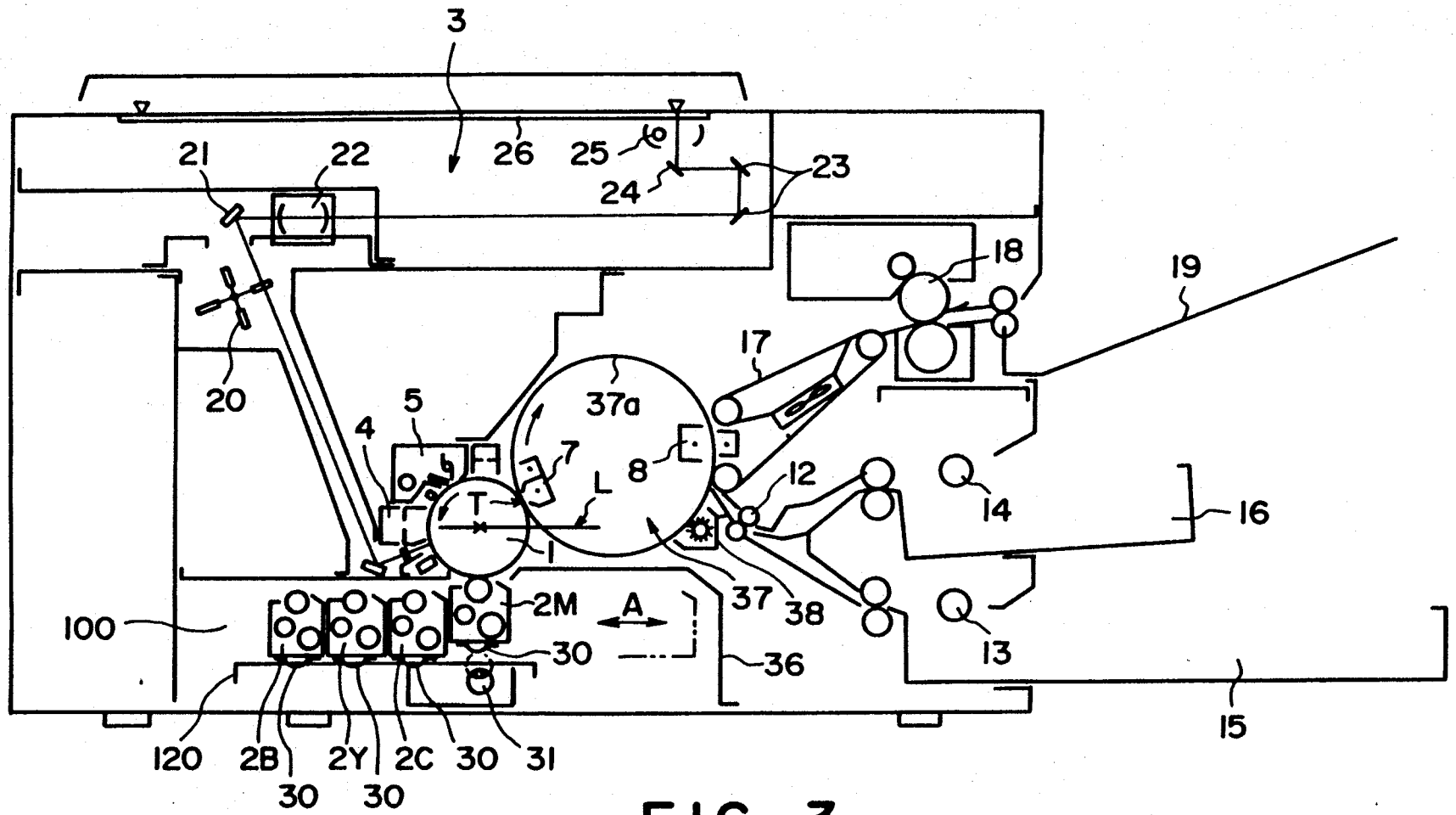
FIG. 3 is a sectional view of an image forming apparatus according to another embodiment of the present invention.

FIG. 3 shows a color electrophotographic copying machine using the intermediate transfer material according to another embodiment of the present invention. In the copying machine of this embodiment, an image of an original supported on a platen 26 is projected onto a photosensitive drum 1 through an optical system comprising a first scanning mirror 24, second and third scanning mirrors 25 moving at a speed which is one half that of the first scanning mirror 24, an imaging lens 22, a fourth mirror 21 fixed and blue, green and red color separation filters 20.

In place of the transfer drum 6 of the FIG. 2 embodiment, an intermediate transfer material in the form of a drum 37 having an intermediate transfer sheet 37*a* is used. Therefore, the toner images formed on the photosensitive drum are tentatively and superposedly transferred onto the intermediate transfer drum 37 at the image transfer position T where the image transfer charger 7 is disposed, and then, the toner image on the intermediate transfer drum is transferred onto the transfer material such as a transfer sheet fed from the cassette 15 or 16 by the operation of the transfer charger 8.

The transfer sheet now having the toner image is separated from the intermediate transfer drum 37, and is conveyed to the fixing device 18 by the transfer sheet conveying system 17. The toner image on the transfer sheet is fixed on the transfer sheet by the fixing device 18, and it is discharged to the tray 19. From the intermediate transfer drum 37, the residual toner is removed by the cleaner to be prepared for the next image formation process.

The image forming process performed on the surface of the photosensitive drum, and the structure therefor are the same as in the embodiment of FIG. 2, and therefore, the detailed description thereof are omitted by assigning a same reference numerals as in FIG. 2 to the embodiments having the corresponding functions.

In this embodiment, the transfer position T where the toner image formed on the photosensitive drum 1 is transferred onto the rotatable intermediate transfer drum 37 is above the horizontal line L passing through the center of the photosensitive drum 1, and the developing units 2M, 2C, 2Y and 2B of the developing device 100 are disposed below the photosensitive drum 1.

The description will be made as to the details of the developing device used in the image forming apparatus of this embodiment.

The developing device 100, as described in the foregoing, is reciprocally and rectilinearly movable along a horizontal plane. The developing units are disposed right below and closely to the photosensitive drum 1 with a predetermined gap. After the developing operation is completed, the developing unit is maintained away from the developing position.

In this embodiment, the developing units 2 (2M, 2C, 2Y and 2B) have the same structure, and only the colors of the toners contained therein are different. Here, marks "M", "C", "Y" and "B" represent magenta, cyan, yellow and black colors for the respective developing units.

Figure 4:
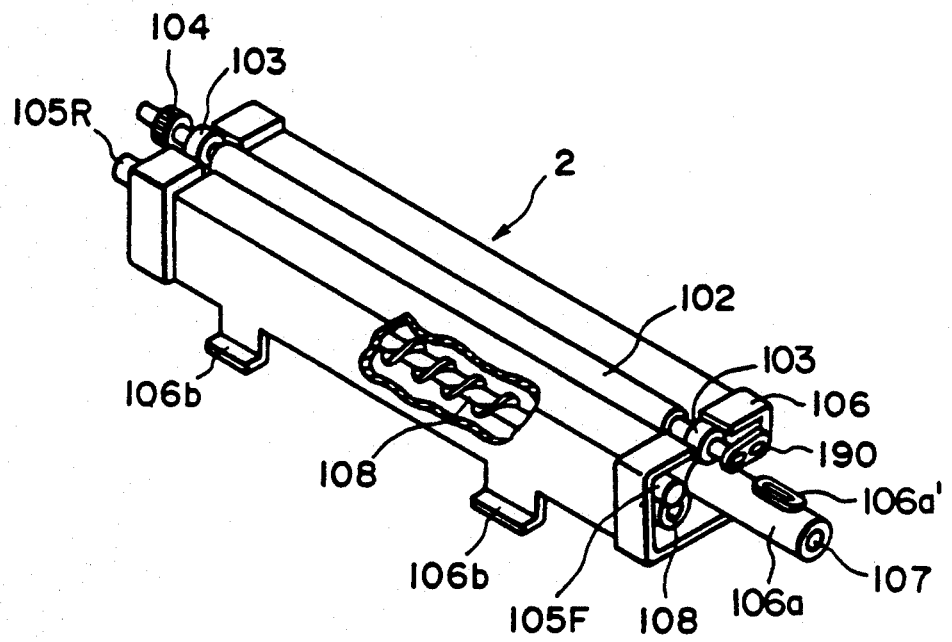
FIG. 4 is a perspective view of a developing unit.
Figure 5:
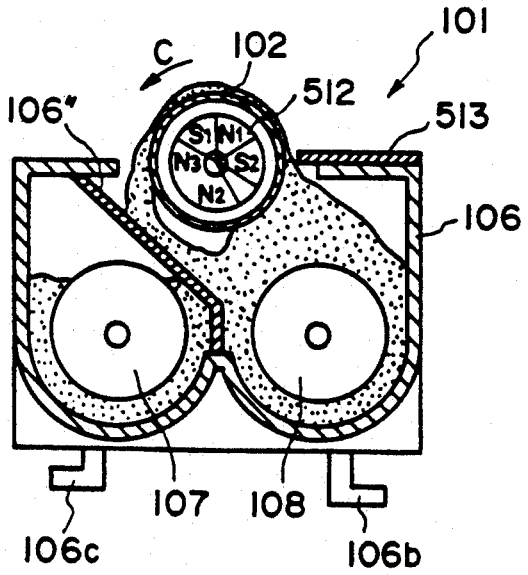
FIGS. 5 and 6 are sectional views of the developing unit.
Figure 6:
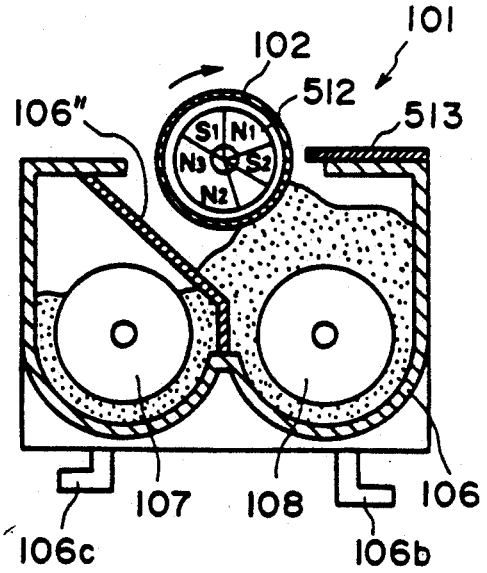

Referring to FIGS. 4-6, the developing unit in this embodiment includes an elongated developer container 106 having a rectangular cross-section, in which a developing sleeve 102 enclosing a magnet 512 is rotatably supported. At the opposite longitudinal ends of the developing sleeve 102, there are spacer rollers 103 to maintain a predetermined clearance from the photosensitive drum 1. To one of the longitudinal ends of the developing sleeve 102, a driving gear 104 for driving the developing sleeve 102 is fixed to transmit the driving force to the developing sleeve 102 from a motor 125 (FIG. 9) through a transmission mechanism.

The magnet 512 in the developing sleeve 102 is correctly positioned within the developing sleeve 102 by a positioning plate 190 at the other end of the developing sleeve 102.

At the opposite ends of the developer container 106, pins 105F and 105R are mounted extending coaxially parallel with the longitudinal axis of the developing sleeve 102 to be mounted at correct position on the movable carriage 120 which will be described hereinafter.

Figure 7:
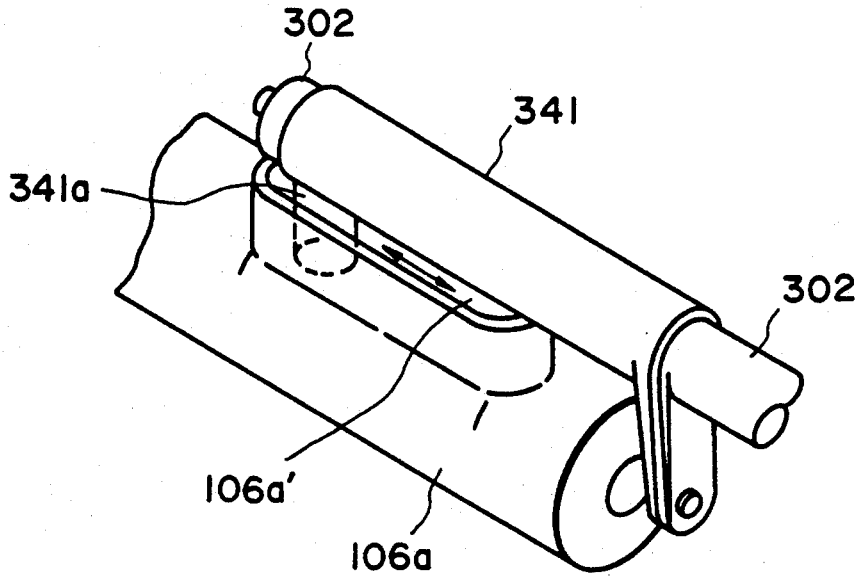
FIG. 7 is a perspective view of a part of a toner supplying mechanism for supplying toner to the developing unit.
Figure 8:
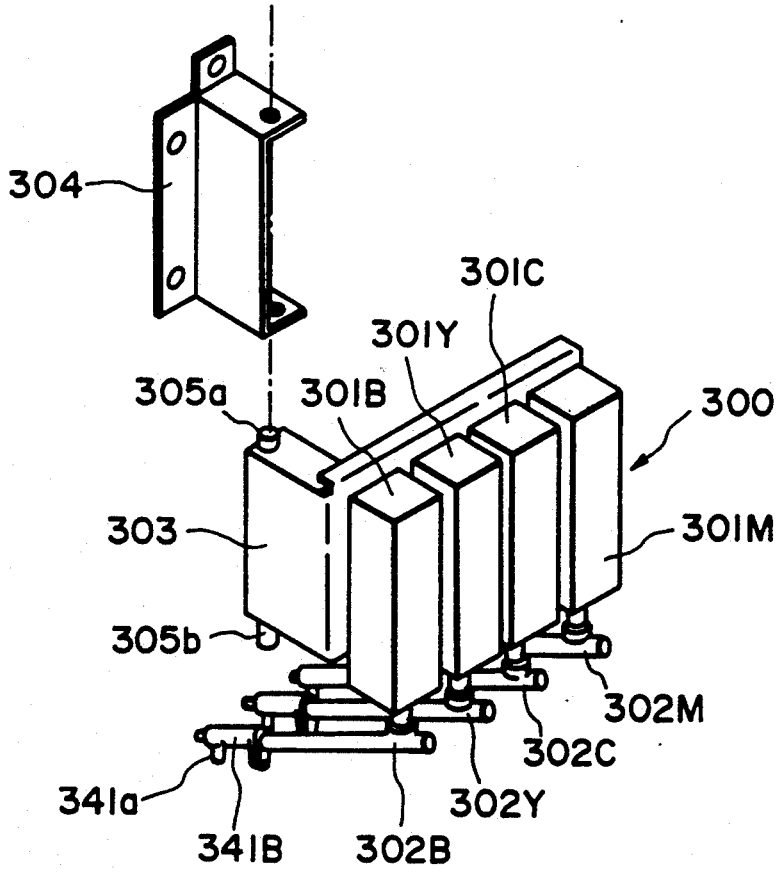
FIG. 8 is a perspective view illustrating the entire toner supplying mechanism.

Within the developer container 106, there are screws 107 and 108 for stirring and conveying the developer therein, and the screws 107 and 108 are driven by the driving gear 104 for the developing sleeve 102 through a gear train (not shown). One of the screws, that is, the screw 107 in this embodiment, has an end projecting from the developer container 106 toward the front side, and is extended into a conveying pipe 106*a* connected to a toner supplying device which will be described hereinafter. As shown in FIG. 7, the conveying pipe 106*a* is provided with an elongated supply port 106*a'* at its top portion to connect with the toner supply device (FIG. 8).

As shown in FIG. 5, the developing sleeve 102 rotates in the direction of arrow C during the developing operation, by which the developer containing the toner particles and magnetic carrier particles are caught by a magnet pole N2, and the height of the magnetic brush of the developer is regulated by a magnetic pole S2 and a blade 513. Further, the developer is carried to the position of the magnetic pole S1 by a magnetic pole N1. During this, the developer is supplied to the photosensitive member to develop the latent image thereon. With further rotation of the developing sleeve 102, the developer on the developing sleeve 102 is removed from the developing sleeve at the position of a magnetic pole N3 because the magnetic polarity of the pole N3 is the same as that of the magnetic pole N2. The removed developer is returned toward the screw 108 by a partition plate 106'', and is recirculated to contribute to the developing operation again.

As shown in FIG. 6, when the motor 125 which will be described hereinafter is reversely rotated after the completion of the developing operation, the developing sleeve 102 moves in a direction opposite to the direction of the arrow C. Then, the developer is not caught on the developing sleeve 102 because the removing pole N3 and the catching pole N2 have repelling magnetic poles. Therefore, the developer on the developing sleeve 102 is not conveyed so that no magnetic brush is formed thereon. The reverse rotation may preferably be performed, but is not inevitable.

The bottom of the developer container 106 is provided with guiding legs 106*b* and 106*c* (FIGS. 4 and 5), which are slidably engaged with a sliding guide 121 (FIG. 9) mounted to the movable carriage 120.

As shown in FIG. 7, the supply port 106*a'* of the conveying pipe 106*a* is engaged with a supply opening 341*a* of a shutter 341 of a supply pipe 302. Therefore, when the developing unit 2 moves, the supply opening 341*a* is guided by the supply port 106*a'* of the developing unit following the lateral movement of the unit, and the supply pipe 302 swings to permit toner supply at all times.

FIG. 8 shows an example of the toner supply device 300. FIG. 8 is a perspective view showing a general arrangement of the toner supply device 300 without detailed parts. The toner supply device 300 comprises toner containers 301M, 301C, 301Y and 301B for containing magenta, cyan, yellow and black toner particles, and supply pipes 302M, 302C, 302Y and 303B containing respective screws swingably connected to the toner containers 301M–301B to supply the toner particles from the containers to the respective developing units 2M, 2C, 2Y and 2B. The supply opening 341*a* of the shutter 341 of the supply pipe 302 is engaged with a part of the developing unit, that is, the supply port 106*a'*, as described hereinbefore to supply the toner to the developer container 106.

The parts constituting the toner container of the toner supply device 300, the supply pipe and other elements are mounted to a supporting plate 303. The supporting plate 303 is rotatably mounted on a bracket 304 securedly fixed on a front frame of the copying machine by pins 305*a* and 305*b*. During the copying operation, the supporting plate 303 is rotated toward the front side, and its end at the opposite side from the pins is fixed by screws or the like to the front frame.

Figure 9:
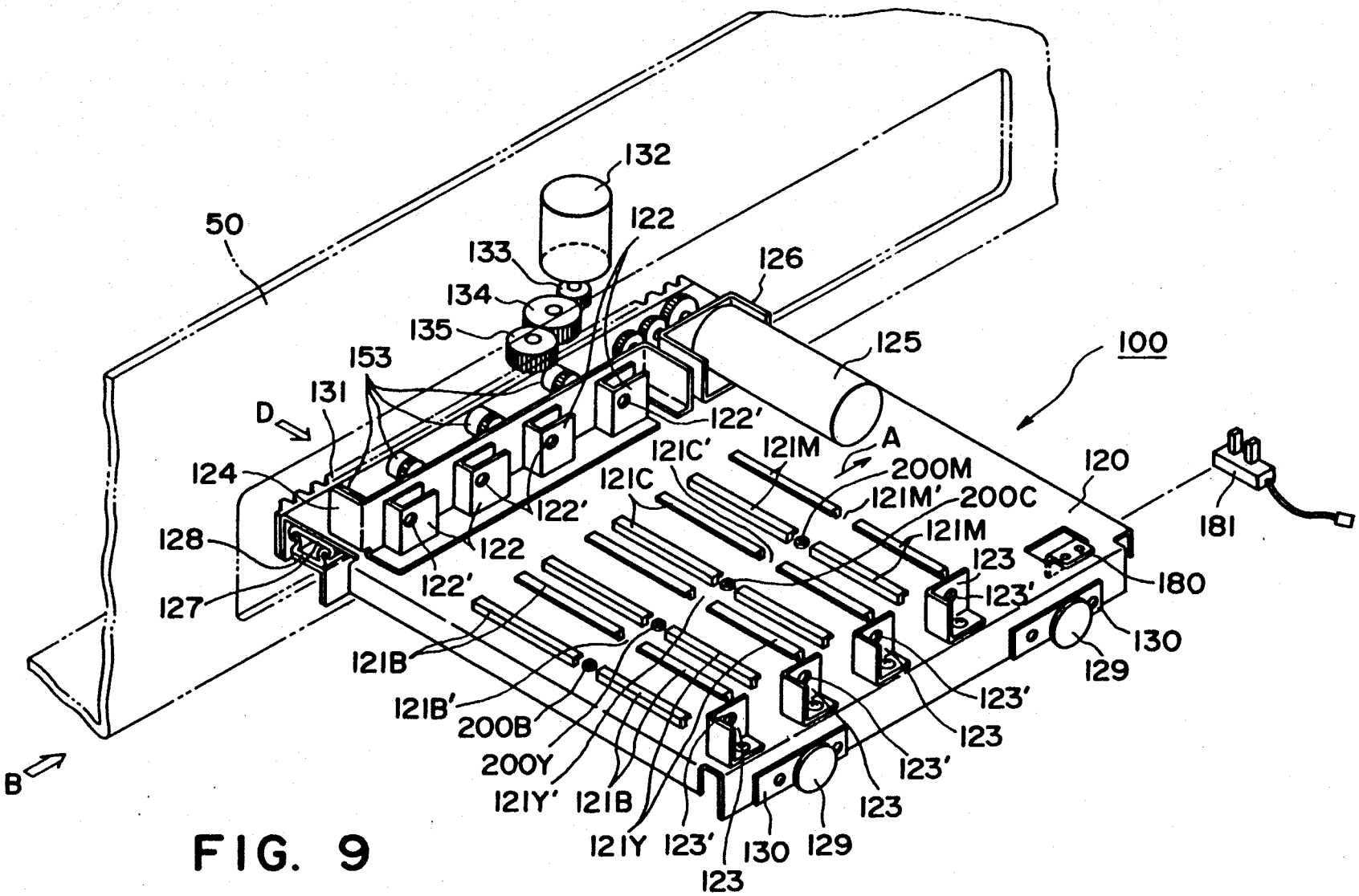
FIG. 9 is a perspective view of a major portion of the developing apparatus.

FIG. 9 is a perspective view of the developing apparatus 100 seen from front, upper left side of the copying machine, wherein the developing units 2 are omitted for simplicity.

The developing device 100 includes a movable carriage 120 for carrying the developing units 2. The carriage 120 is provided with sliding guides 121 (121M, 121C, 121Y and 121B) fixedly mounted thereto, which are engaged with the guiding legs 106*b* and 106*c* of the developing units to support them. At a position between the opposite longitudinal ends of the sliding guide, it is provided with cut-away portions 121M'–121B' to release the legs of the developer container when the developing unit swings to approach the photosensitive drum 1.

The carriage 120 is provided with a rear supporting plate 122 and a front supporting plate 123 corresponding to the sliding guides 121. The rear supporting plate 122 is provided with a hole 122' engageable with a pin 105R of the developing unit 2, and the front supporting plate 123 is provided with a hole 123' engageable with the pin 105*f* of the developing unit 2. The developing unit 2 is inserted along the sliding guide 121, and the pin 105R is inserted into the hole 122' of the rear supporting plate 122, and thereafter the pin 105F and the hole 123' of the front supporting plate 123 are engaged, and then, the front supporting plate 123 is fixed to the carriage 120 by screws. The holes 122' and 123' of the rear supporting plate 122 and the front supporting plate 123 of each of the developing units are adjusted during assembly using a jig or the like so that they are coaxial parallel with the axis of the photosensitive drum 1.

Figure 10:
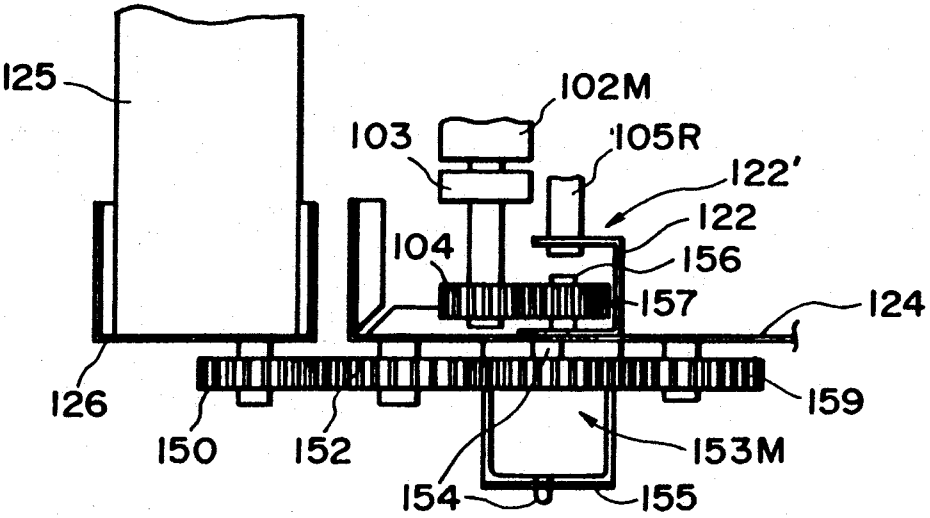
FIG. 10 is a top plan view of a part of the developing apparatus.
Figure 11:
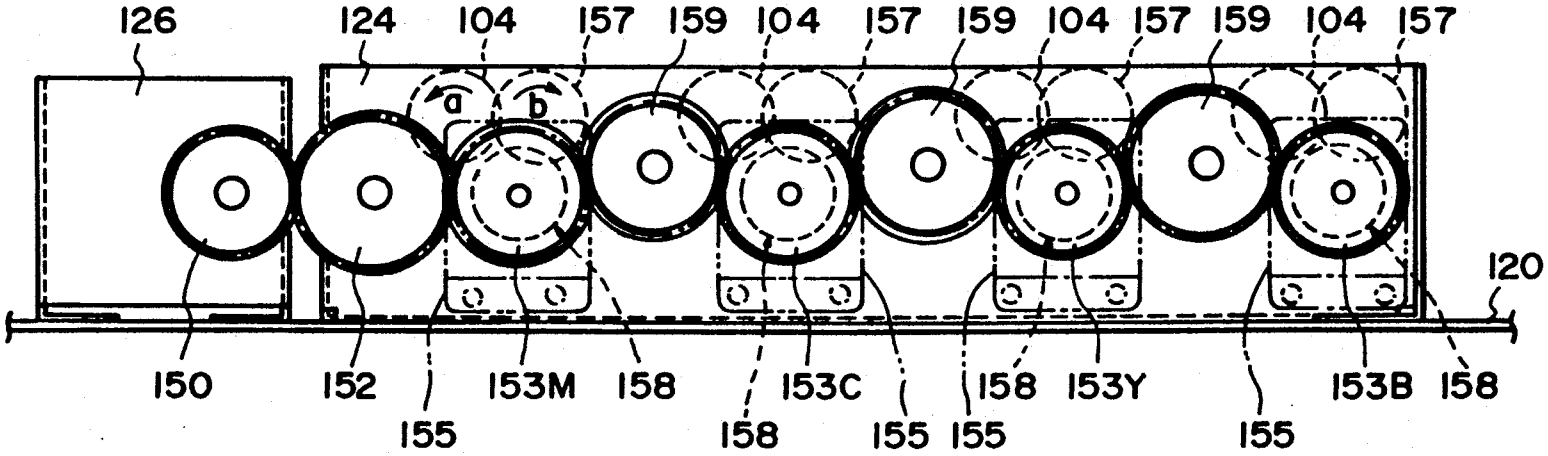
FIG. 11 is a side view of a part of the developing apparatus.

As shown in FIGS. 10 and 11, the rear supporting plate 122 in this embodiment is fixed to a driving base 124 by screws, the driving base 124 supporting driving gear and clutches which will be described hereinafter. The driving base 124 is screwed on the movable carriage 120. To the carriage 120, a supporting plate 126 for supporting the DC motor 125 is mounted by screws.

Figure 19:
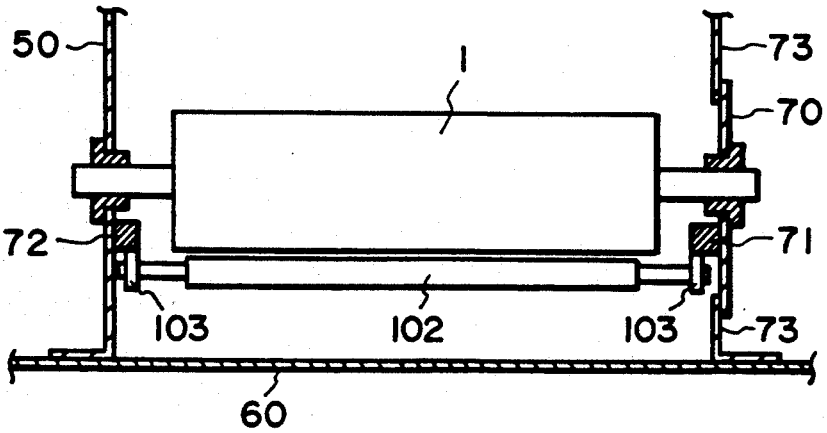
FIG. 19 is a partly sectional side view illustrating a relation between a drum and a sleeve.

As shown in FIG. 9, the carriage 120 is provided with a rail 127 adjacent the rear end of the carriage 120. The rail 127 is slidably engaged with a rail support 128 mounted on the rear supporting plate 50 fixed on a bottom frame 60 of the copying machine. At the front side end of the movable carriage 120, a roller 129 having a bearing therein is rotatably supported through a supporting plate 130. The roller 129 rolls on the bottom plate 60 (FIG. 19). Thus, the movable carriage 120 is rectilinearly movable relative to the bottom plate and the rear plate 50.

The movement of the movable carriage 120 is effected by transmitting the driving force of the stepping motor mounted on the bottom frame 60 by suitable supporting means (not shown) to a rack 131 fixed on the movable carriage 120 through a gear train mounted on the supporting means and having gears 133, 134 and 135.

According to this embodiment, the carriage 120 is moved substantially along the tangential direction of the circular peripheral of the photosensitive drum, and is positioned relative to the photosensitive drum with a predetermined gap substantially right below the photosensitive drum, that is, the developing position.

Referring to FIGS. 10 and 11, the driving mechanism for the developing sleeve 102 for driving it by the DC motor 125 will be described. FIG. 11 is a view of the driving mechanism seen from the front side of the rack 131, that is, the B arrow direction of FIG. 9. FIG. 10 is a top plan view.

The output of the DC motor 125 is transmitted to an output gear 150, an idler gear 152 mounted on the drive base 124, and to a clutch gear 153M rotatably supported on the drive base 124 and the supporting plate 155 and for selectively transmitting the driving force to the developing sleeve 102 (FIG. 4). The driving force from the clutch gear 153M is transmitted to the gear 157 mounted on the drive base 124 through its rotational shaft 154 and an output gear 158. A gear 157 is coaxial with the pin 105F and 105R, that is, the axis of the gear 157 is coaxial with the pivot of the swinging movement of the developing unit.

As will be understood when FIGS. 4 and 9 are referred to, when the magenta developing unit 2M is inserted along the sliding guide 121M, the rear pin 105R of the developing unit 102 is engaged into the hole 122' of the rear supporting plate 122 by which as shown in FIG. 10, the gear 157 and the driving gear 104 of the developing sleeve 102 are brought into meshing engagement.

As shown in FIG. 11, for the developing units 2C, 2Y and 2B, the driving mechanism including the clutch gear 153C, 153Y and 153B is provided similarly, and the driving mechanisms are connected by a relay gear 159 mounted on the drive base 124, and the driving force is transmitted from the DC motor 125.

In addition, when the developing unit 2 is inserted along the sliding guide 121, a contact (not shown) provided on the carriage 120 to apply a high voltage to the developing sleeve 102 is electrically connected with a contact (not shown) provided on the developing unit 2, by which a high voltage can be applied to the developing sleeve 102 during the developing operation.

As shown in FIG. 9, with the structure described above, when a main switch of the copying apparatus is closed, it is checked whether or not the carriage 120 is at its home position or not by a sensor 181 constituted by a light emitting element and a light receiving element fixed on the bottom plate 60 and a light blocking plate adjustably mounted on the carriage 120. If the movable carriage 120 is not at the home position, the stepping motor 132 is rotated to move the movable carriage 120 to a position where the light of the sensor 181 is blocked by the light blocking plate 180, that is, to the home position.

In the embodiment shown in FIGS. 2 and 3, the developing unit raising mechanism for raising the developing unit toward the photosensitive drum 1 engages the cam member 31 with the engaging portion 30 provided on the bottom of the developer container. Another developer unit raising mechanism will be described in conjunction with FIG. 12.

Figure 12:
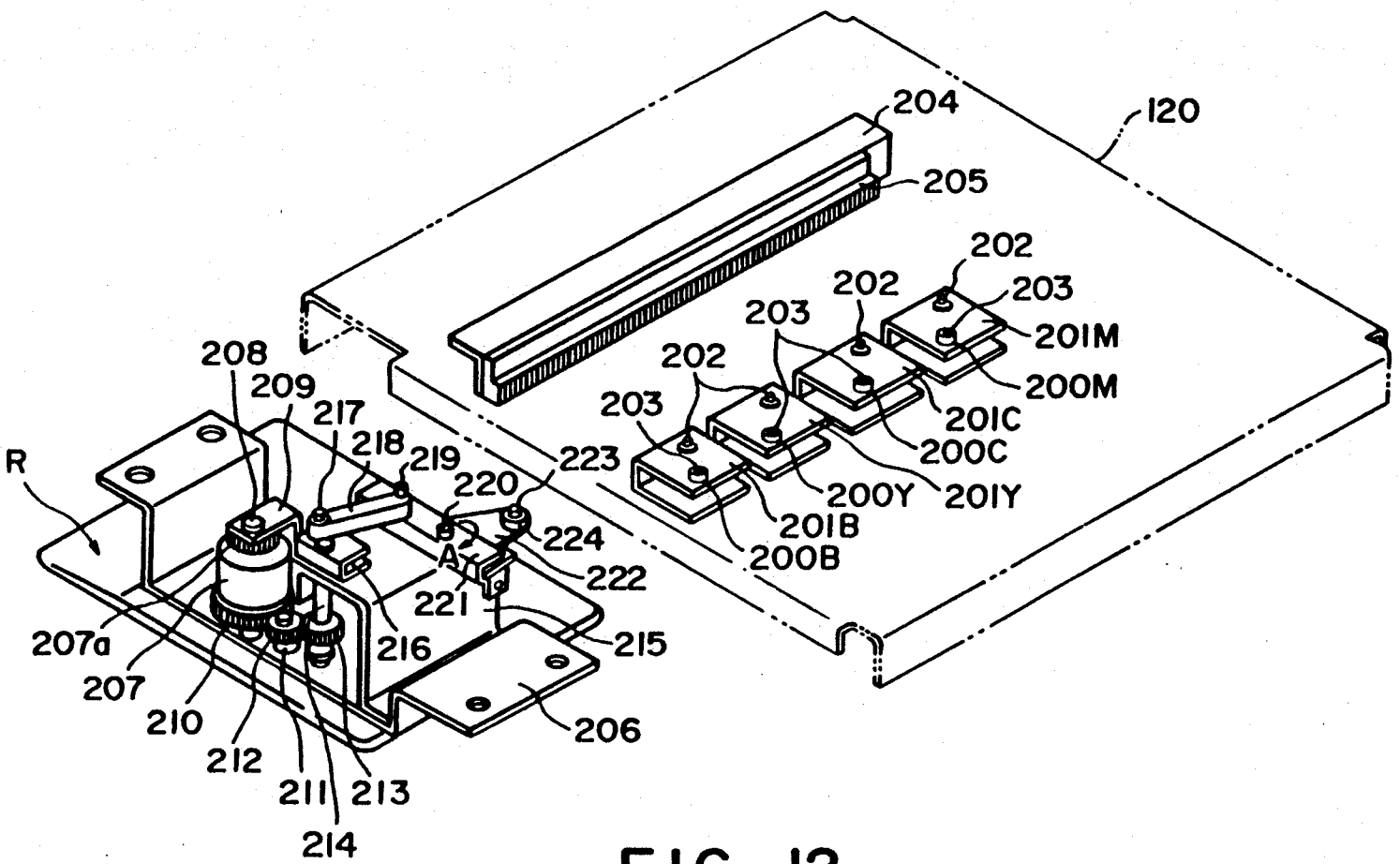
FIG. 12 is a perspective view of another major portion of the developing apparatus.

In FIG. 12, the sliding guides 121M, 121C, 121Y and 121B are omitted for better understanding of various parts in the movable carriage 120.

At a position between the opposite ends of one of the slide guides 121M (121C, 121Y or 121B) constituting a parallel pair, a cut-away portion 121M' (121C', 121Y' or 121C') is formed to release the leg of the developer container when the developing unit 2 swings toward the photosensitive drum 1, as described in conjunction with FIG. 9.

At a position between the opposite ends of the other slide guide, there is an urging member, more particularly a roller 200M (200C, 200Y or 200B) for urging the leg of the container to raise the developing unit to the photosensitive drum.

Figure 13:
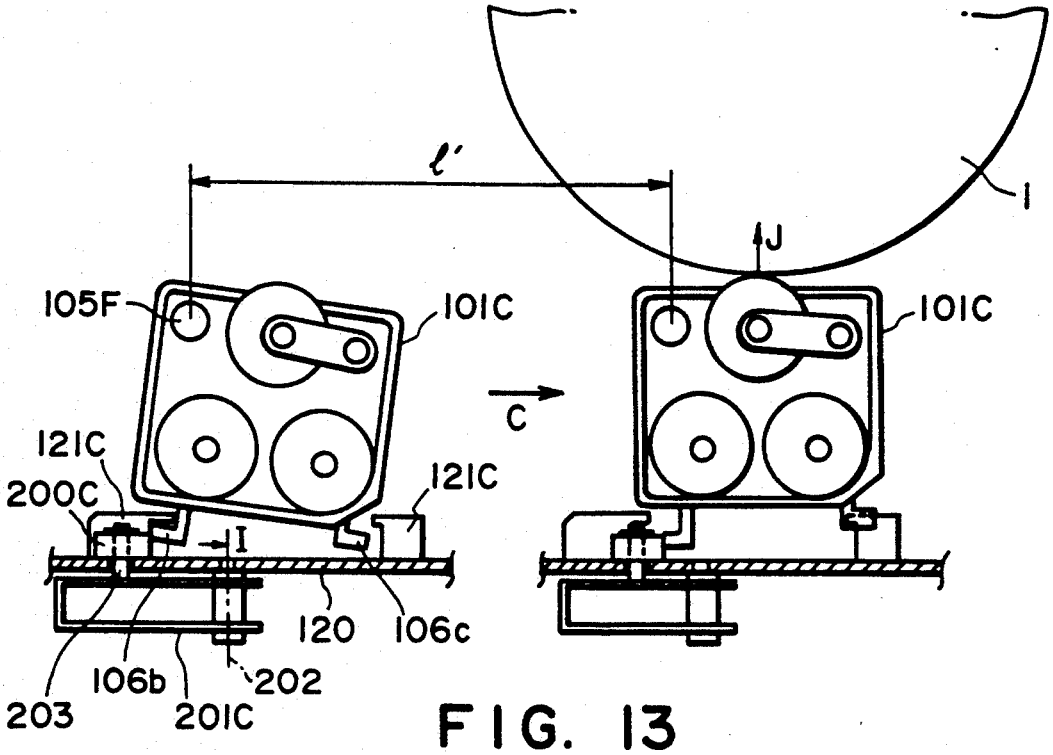
FIG. 13 is a sectional view of the developing apparatus illustrating operation thereof.

As shown in FIGS. 12 and 13, a bottom surface of the movable carriage 120 is equipped with a roller supporting plate 201 (201M, 201C, 201Y and 201B) constituting a mechanism for raising the developing unit. The roller supporting plate 201 is rotatably supported by a shaft 202 fixedly mounted to the bottom surface of the carriage 120. To the roller supporting plate 201, a shaft 203 is fixedly mounted penetrating the carriage 120. The rollers 200M–200B are rotatably supported on the shaft 203.

The movable carriage 120 is provided with a hole (not shown) for the shaft 203 to permit the shaft 203 to rotate integrally with the roller supporting plate 201.

Referring to FIG. 12, the bottom surface of the movable carriage 120 is provided with an L shaped member 204 fixedly mounted thereon. The rack 205 is mounted on the member 204. The rack 205, which will be described in detail hereinafter, functions to transmit the driving force from the pulse motor 132 to the developing unit raising mechanism.

The description will be made as to the mechanism for raising the developing unit to the photosensitive drum by the driving force from the pulse motor 132.

Referring to FIG. 12, the developing unit raising mechanism is disposed below the movable carriage 120, and is accommodated in a region R defined by a recess formed in a bottom frame of the copying apparatus. The members constituting the raising mechanism are securedly fixed to the bottom frame of the copying apparatus through supporting plate 206.

The raising mechanism includes a selective drive transmission member in the form of an electromagnetic clutch 207 having a gear **207*a* normally meshed with the rack 205 fixed on the bottom surface of the movable carriage. The rotational shaft 208 of the electromagnetic clutch 207 is supported by the supporting plate 206 and the L shaped member 209 fixed to the supporting plate 206, more particularly, it is rotatably supported thereby through bearings. Below the electromagnetic clutch 207, there is a gear 210 integral with the rotational shaft 207**.

The gear 210 is operatively connected with a gear 213 through a gear 212 rotatably mounted on the shaft 211 fixed to the supporting plate 208. The gear 213 is integrally mounted on the shaft 214, and the shaft 214 is rotatably supported through bearings by the supporting plate 206 and a supporting table fixed to the supporting plate 206. To one end of the shaft 214 projected from the supporting table 215, a crank plate 216 having a channel-like shape is integrally mounted.

To the crank plate 216, a shaft 217 is fixed at a position away from the shaft 214 through a predetermined distance. To the shaft 217, an end of a link 218 made of material having good sliding property such as resin is rotatably engaged. The other end of the link 218 is rotatably engaged on the shaft 219 mounted to an end of a channel-like member 221. The channel-like member 221 is rotatable about a shaft 220 fixed on the supporting plate 215. Inside the channel-like plate 221, there is another channel-like plate 222 rotatably mounted on the rotational shaft 220 of the channel-like plate 221.

Between the channel-like plates 222 and 221, an urging member (not shown) such as spring is stretched to urge the channel-like plate 222 in the direction of an arrow A, that is, toward the channel-like member 221. The channel-like member 222 is stopped at a predetermined position relative to the channel-like member 221 by abutment of a part thereof to the channel-like member 221. A shaft 223 is fixedly mounted to the channel-like plate 222 at a position away from the rotational shaft 220. A roller 224 is rotatably mounted on the shaft 223. The roller 224 is contacted to the outer surface of a curved portion of the roller supporting member 201 having a channel-like cross-section.

The description will be made as to the developing unit raising operation to the photosensitive drum by the raising mechanism having the structure described above.

When the main switch of the copying apparatus is closed, the movable carriage 120 is returned to its home position with the aid of the sensor 181 and the light blocking plate 180. In this embodiment, the home position is such a position that the distances from a position right below the photosensitive drum to the magenta developing unit 2M and the cyan developing unit 2C are the same, that is, such a position that the center of the photosensitive drum is above the center between the magenta developing unit 2M and the cyan developing unit 2C.

Figure 15:
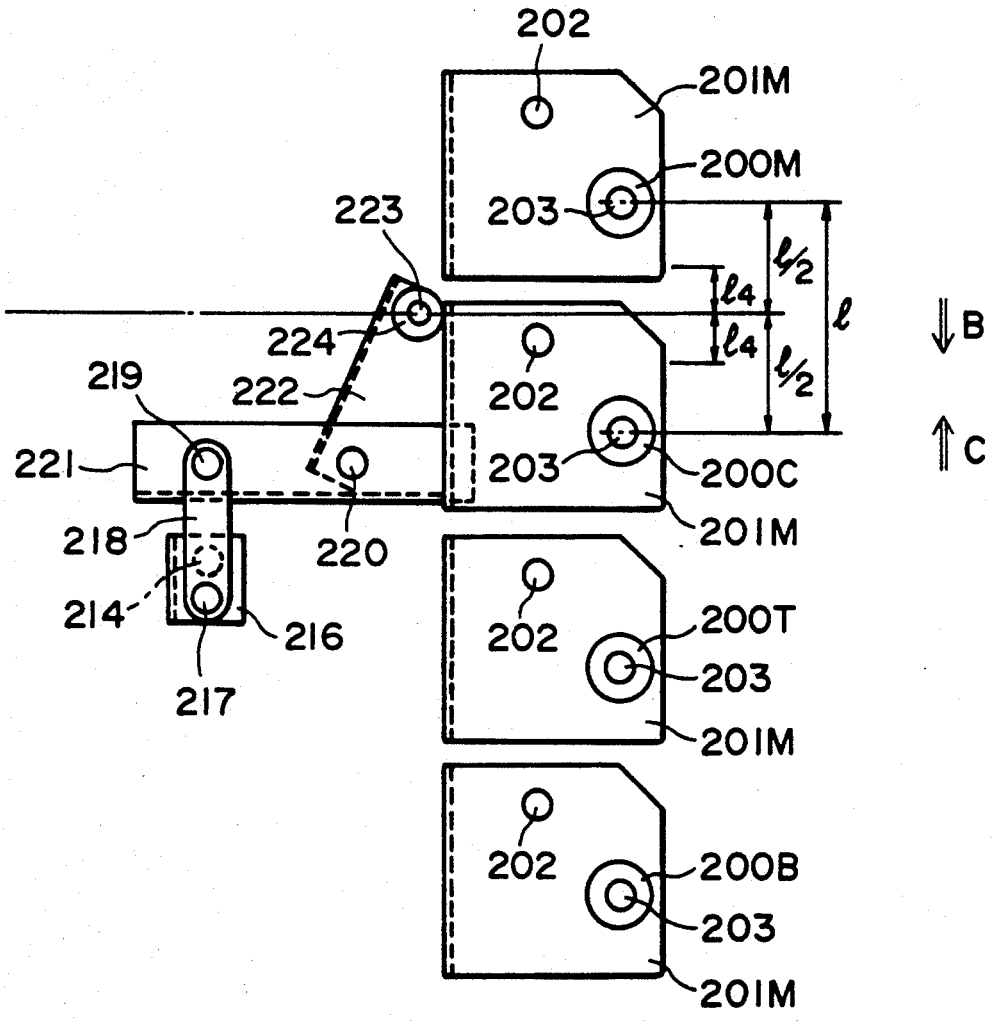
FIG. 15 is a sectional view of the developing apparatus of a major portion.

FIG. 15 shows the positional relation between the raising mechanism disposed below the movable carriage 120 and the roller supporting plate 201 disposed on the backside of the movable carriage 120 when the movable carriage 120 is at the home position, in a top plan view. The roller 224 in the raising mechanism is placed at the center between the magenta developing unit 2M and the cyan developing unit 2C, that is, right below the photosensitive drum, when the movable carriage 120 is at the home position. The roller 224 is contacted to the curved surface of the roller supporting plate 201C of the developing unit 2C to raise the cyan developing unit 2C.

Figure 14:
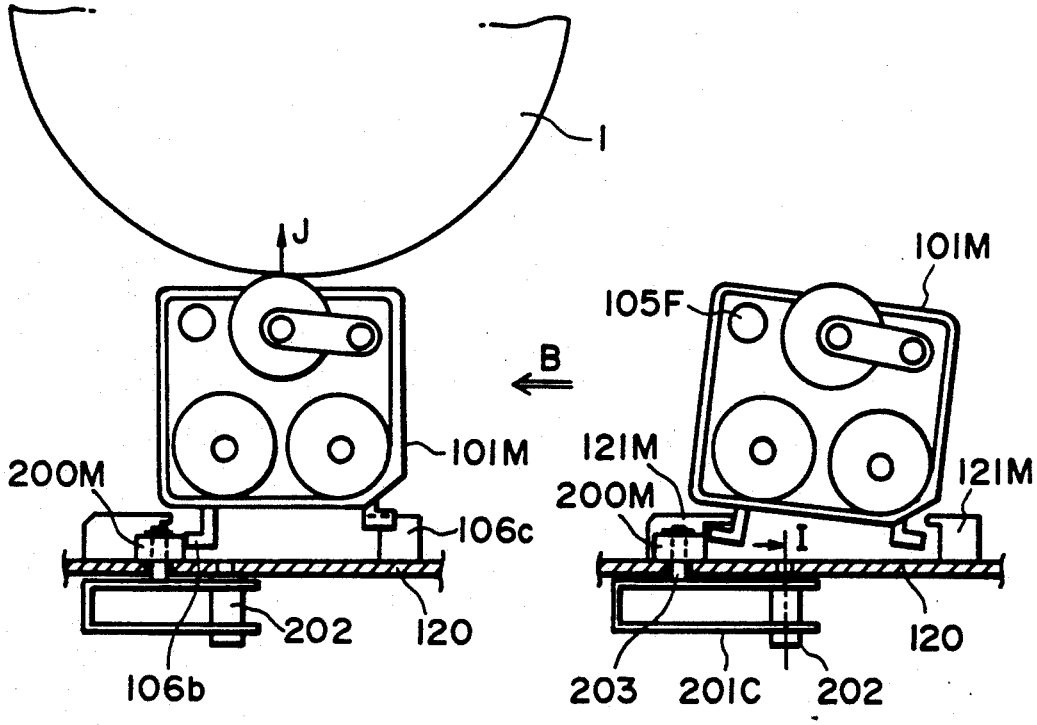
FIG. 14 is another sectional view of the developing apparatus illustrating the operation thereof.
Figure 16:
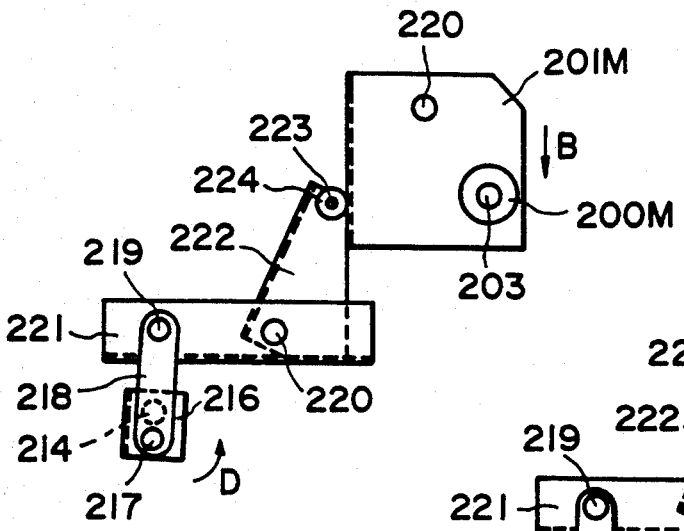
FIGS. 16, 17 and 18 illustrate operation of a link mechanism.

Now, the description will be made as to the developing operation using the magenta developing unit 2M. When the magenta developing unit 2M is used to develop the image, the movable carriage 120 moves in the direction B, as shown in FIG. 14, during the copying (image forming) operation. When the movable carriage 120 first moves through a distance $l_4$ that is, when it is before the developing position by the distance of $(l/2)-l_4$. An MPU controlling the apparatus supplies an ON signal to the electromagnetic clutch 207 of the raising mechanism. By this, as will be understood from FIG. 12, the movement of the carriage 120 is transmitted to the shaft through the rack 205 on the backside of the movable carriage 120 and the gear **207*a* normally meshed therewith, by which the shaft 208 starts to rotate in association with movement of the movable carriage 120. When the shaft 208 rotates, the gear 210 fixed to the shaft 208 rotates, and the rotation is transmitted to the shaft 214 through the gears 212 and 213. By the rotation of the shaft 214, the crank plate 216 rotates in the direction D (FIG. 16). The rotation of the crank plate 216 is transmitted to the channel-like plate 221 by the link 218, by which the channel-like plate 221 rotates in the direction F (FIG. 18**).

Figure 18:
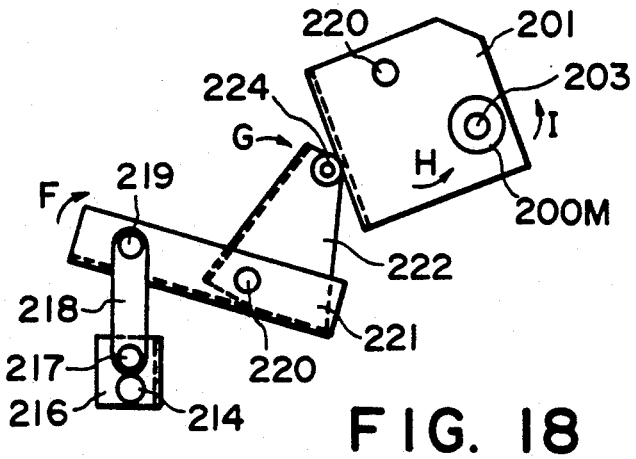

At this time, the channel-like plate 222 is urged by a spring so that it abuts the channel-like plate 221, and therefore, it rotates in the direction G by the rotation of the channel-like plate 221 (FIG. 18) therefore, the roller 224 pushes the roller supporting plate 210M of the developing unit 2M disposed at the back side of the movable carriage 120, by which the roller supporting plate 210M is rotated in the direction H (FIG. 18).

When the roller supporting plate 201M rotates in the direction H, the roller 200M on the roller supporting plate 201M moves in the direction I (FIG. 18). Then, as shown in FIG. 14, the roller 200M moving in the direction I pushes the leg **106*b* of the magenta developing unit 2M in the same direction so that the magenta developing unit 2M is rotated in the direction J about a pivot provided by the pins 105F and 105R, that is, toward the photosensitive drum during the movement of the carriage 120. When the magenta developing device moves through $(l/2)$, the crank plate 216 rotates one half turn, by which the magenta developing unit 2M stops at the developing position right below and close to the photosensitive drum 1**.

As shown in FIG. 19, when in the developing position, the spacer roller 103 is abutted to positioning blocks 71 and 72 fixed at a position having a predetermined positional relation relative to the central axis of the drum to maintain a predetermined gap between the drum 1 and the sleeve 102. Alternatively, the spacer roller 103 may be abutted to the peripheral surface of the drum 1.

In the raising mechanism, the gear trains **207*a*, 210, 212 and 213 are constructed such that at the time of the completion of the movement of the movable carriage 120, the crank plate 216** rotates through one half, and then stops.

That is, the electromagnetic clutch 207 is energized from the time when the distance is $(l/2)$ to the time when it is $l_4$, namely, only during the time corresponding to the distance $(l/2)-l_4=l'$. During this period, the shaft 208 rotates through the rack 205 by $$l'/(Z1/2)\ \text{(rad)}$$

where Z1 is a number of teeth of the gear 207. During the carriage 120 moving through the distance $l'$, the shaft 214 of the cam plate 216 rotates through $$l/(Z1/2)\times(Z2/Z3)=2l'Z2/Z1\ Z3\ \text{(rad)}$$

where Z2 is a number of teeth of the gear 210 mounted integrally to the bottom of the shaft 208; Z3 is a number of the gear 213 integrally mounted on the shaft 214 of the cam plate 216.

Therefore, the gear train is designed so as to satisfy $$2l'(Z2/Z1)Z2=\pi\ \text{(rad)}.$$

The home position of the developing device 100 is not limited if it satisfies that the center of the photosensitive drum is between the magenta developing unit 2M and the cyan developing unit 2C. The timing at which the electromagnetic clutch 207 is actuated is such that it is actuated when the developing unit is away from right below the photosensitive drum by $l'=\pi(Z1\times Z3)/2\times Z2)$, irrespective of the home position.

When the developing unit is not raised, there is a distance d in the vertical direction between the spacer roller 103 and the surface of the photosensitive drum. In order to urge the spacer roller 103 to the photosensitive drum 1 or to the members 71 and 72, the amount of rise of the developing unit toward the photosensitive drum surface is determined such that it is $d+\alpha$ ($\alpha$: positive) when the crank plate 216 rotates through one half turn. The dimensions of the link 218 of the raising mechanism is determined so as to satisfy the above.

Thus, when the developing unit is at the home position, the developing unit received reaction force from the members 71 and 72 or the photosensitive drum, corresponding to $\alpha$, and also, the developing unit receives gravity force which is effective to urge it also away from the photosensitive member. Since the channel-like member 222 is rotationally urged to the channel-like member 221 (FIG. 18), the channel-like member 222 receives the reaction force from the member 71, 72 or the photosensitive drum 1 so that it rotates against the spring force away from the channel-like member 221. When the channel-like member 222 stops, the developing unit is urged through the abutting roller 103 to the member 71, 72 or the photosensitive drum 1 by a predetermined force.

By the above operations, the raising operation for the magenta developing unit 2M is completed.

The description will be made as to the operation when the cyan developing unit 2C is raised after the developing operation of the magenta developing unit is completed.

First, the magenta developing unit 2M is displaced away from the photosensitive drum 1 before the cyan developing unit 2C is raised. As shown in FIG. 18, the link 218 is at a top dead point relative to the crank plate 216 by the crank plate 216 rotated through one half turn. In order to retract from the top dead point, the crank plate 216 is slightly rotated by moving the movable carriage 120.

To do this, the movable carriage 120 is driven in the direction C (FIG. 13), and therefore, the electromagnetic clutch 207 is energized for a short period of time at the start of the operation for switching from the magenta developing unit 2M to the cyan developing unit 2C. When the cam plate 216 (FIG. 18) is slightly rotated to retract from the top dead point, the clutch 207 is disengaged, and then, the cam plate 216 rotates by the weight of the developing unit to return to its home position, and the magenta developing unit 2M lowers away from the photosensitive drum 1.

Figure 17:
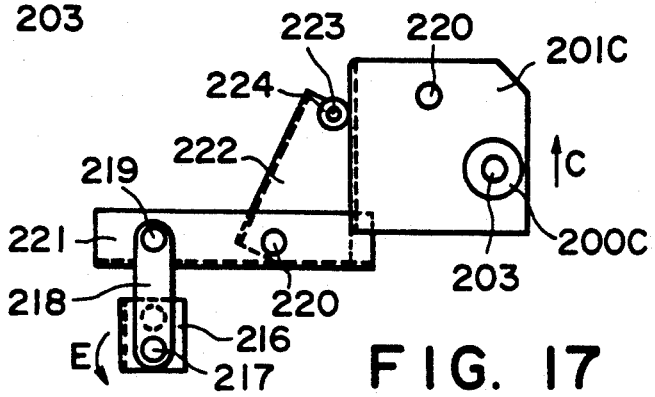

When the cyan developing unit 2C reaches the position which is $l'$ before the developing position (FIG. 13), the electromagnetic clutch 207 is actuated, so that the cam plate 216 rotates in the direction E (FIG. 17) by the movement of the carriage 120. Similarly to the case of the magenta developing unit 2M, the roller 200C of the roller supporting plate 201C moves in the direction I (FIG. 18), by which the cyan developing unit 2C starts to rise toward the photosensitive drum 1. The rising movement ends when $l/2$.

The raising operation during the movement of the magenta developing unit 2M in the direction B (FIG. 14) and the raising operation during the movement of the cyan developing unit 2C in the direction C which is opposite from the direction B (FIG. 13) are the same as to the other color developing units.

Thus, with the raising mechanism having the structure described above, each of the developing units can be raised toward the surface of the photosensitive drum and is properly positioned relative thereto both when the movable carriage is moved in the direction B and when it is moved in the direction C. When the developing operation is completed by a desired number of developing units, the carriage 120 is returned to the home position while the clutch gear 144 is deenergized. At this time, the developing unit is not raised, so that the developer is not deposited onto the photosensitive drum 1.

In the raising mechanism of this embodiment, each of the developing units can be raised toward the photosensitive drum surface using the movement of the carriage 120 when the movable carriage moves rightwardly or leftwardly, and therefore, an additional movement of the carriage which will be required when the movement of the carriage with which the developing unit can be raised is limited to one direction, can be eliminated. Accordingly, the developing device can be moved between adjacent conveying periods for supplying the transfer sheet to a transfer drum or an intermediate transfer drum or the like. As a result, the transfer drum or the intermediate transfer drum is not required to rotate idly for a long period of time when the image forming operation is continuously performed, and therefore, the image formation process speed of the image forming apparatus can be improved to a great extent. Since the idle rotation of the transfer drum or the like during the continuous image forming operation can be reduced without increasing the outside diameter of the transfer drum, the size of the image forming apparatus can be reduced.

Figure 20:
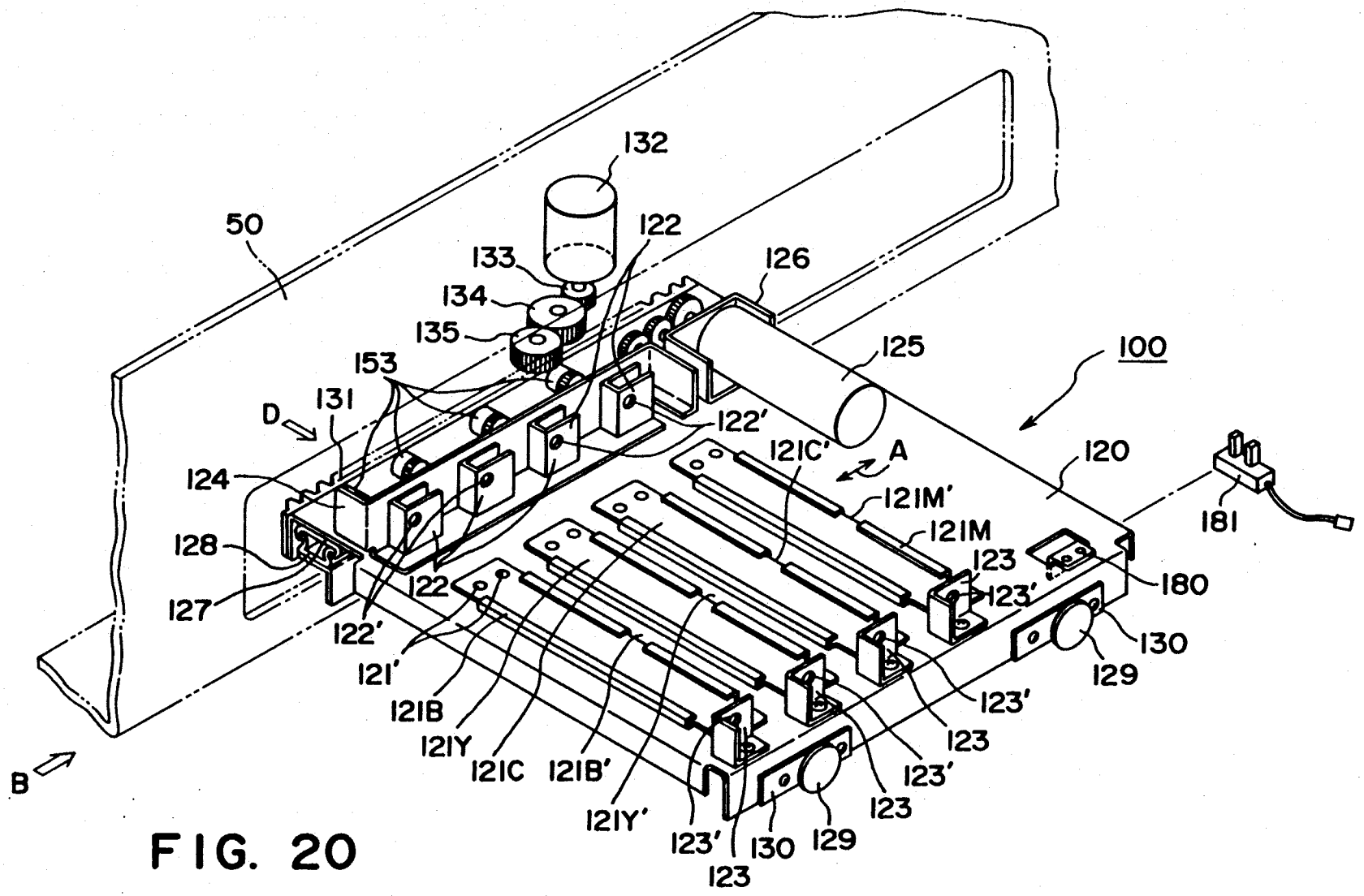
FIG. 20 is a perspective view of a developing apparatus according to another embodiment.
Figure 21:
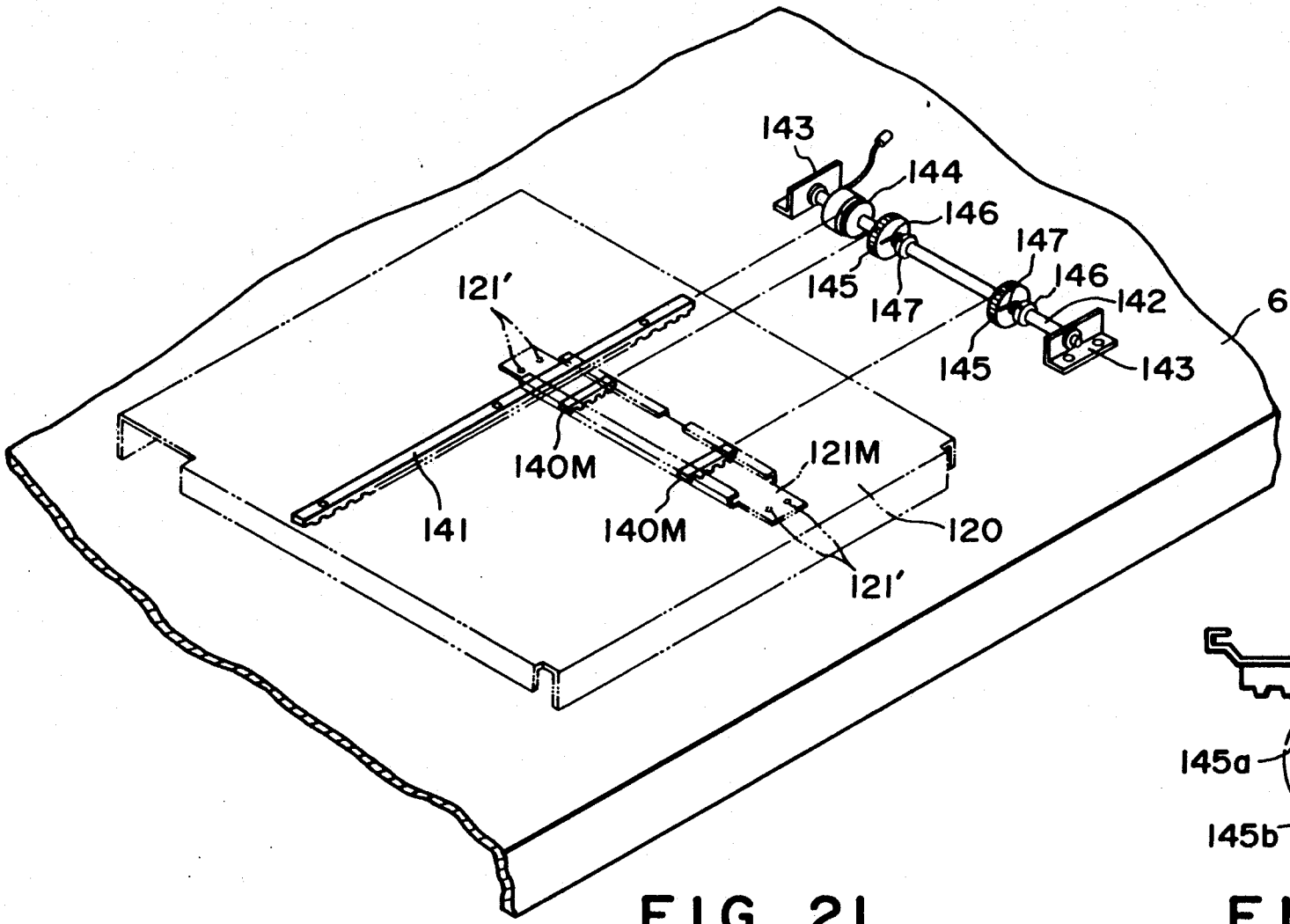
FIG. 21 is a perspective view of a major portion of FIG. 20 apparatus.

Referring to FIG. 21, a further embodiment of the present invention will be described. In the developing apparatus of FIG. 20, the guides 121M, 121C, 121Y and 121B for engagement with the developing units are mounted on the movable carriage 120 by screws 121' having steps so that they are slidable relative to the carriage 120 in the direction A.

FIG. 21 is a perspective view showing a developing unit raising mechanism for raising and positioning the developing unit by raising each of the developing units 101 toward the photosensitive drum 1 adjacent the developing position. In this Figure, in order to illustrate the internal parts for easy understanding, the movable carriage 120 and a slide guide 121M for the developing unit 1M are shown by chain lines, and the slide guides 121C, 121Y and 121B for the other developing units are omitted.

To the backside of the slide guide 121M, a short length rack 140M is fixed, and similarly, such a rack is mounted to each of the slide guide 121C, 121Y and 121B of each of the other developing units. To the backside of the carriage 120, a long rack 141 is fixed.

The bottom plate 60 is provided with a rotational shaft 142 rotatably supported by a supporting plate 143. The rotational shaft 142 has a clutch gear 144 mounted thereto at a position for engagement with the rack 141 of the backside of the carriage 120. When the clutch gear 144 is supplied with a voltage, the rotation of the gear is transmitted to the shaft 142.

The rotational shaft 142 is provided with a gear 145 at a position for engagement with the rack 140M at the backside of the slide guide 121. The number of teeth Z144 of the clutch gear 144 is smaller than the number of teeth Z145 of the gear 145. The reason for this will be described in detail hereinafter.

Figure 22:
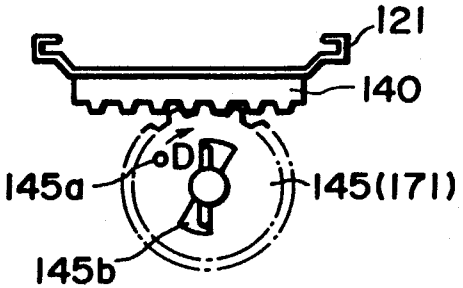
FIG. 22 is a side view of a major portion of the developing apparatus.

Adjacent to the gear 145, the rotational shaft 142 is provided with a ring 146 fixed thereto. Between the gear 145 and the ring 146, a coil spring 147 is provided. An end of the coil spring 147 is engaged with a groove (not shown) of the ring 146, and the other end thereof, as shown in FIG. 22, is engaged with a hole 145*a* formed in a side of the gear 145. In the gear 145, a parallel pin groove 145*b* is formed in sector forms. The gear 145 is urged in the direction of the arrow by the coil spring 147, and an end of the sector groove is abutted to the parallel pin.

Figure 24:
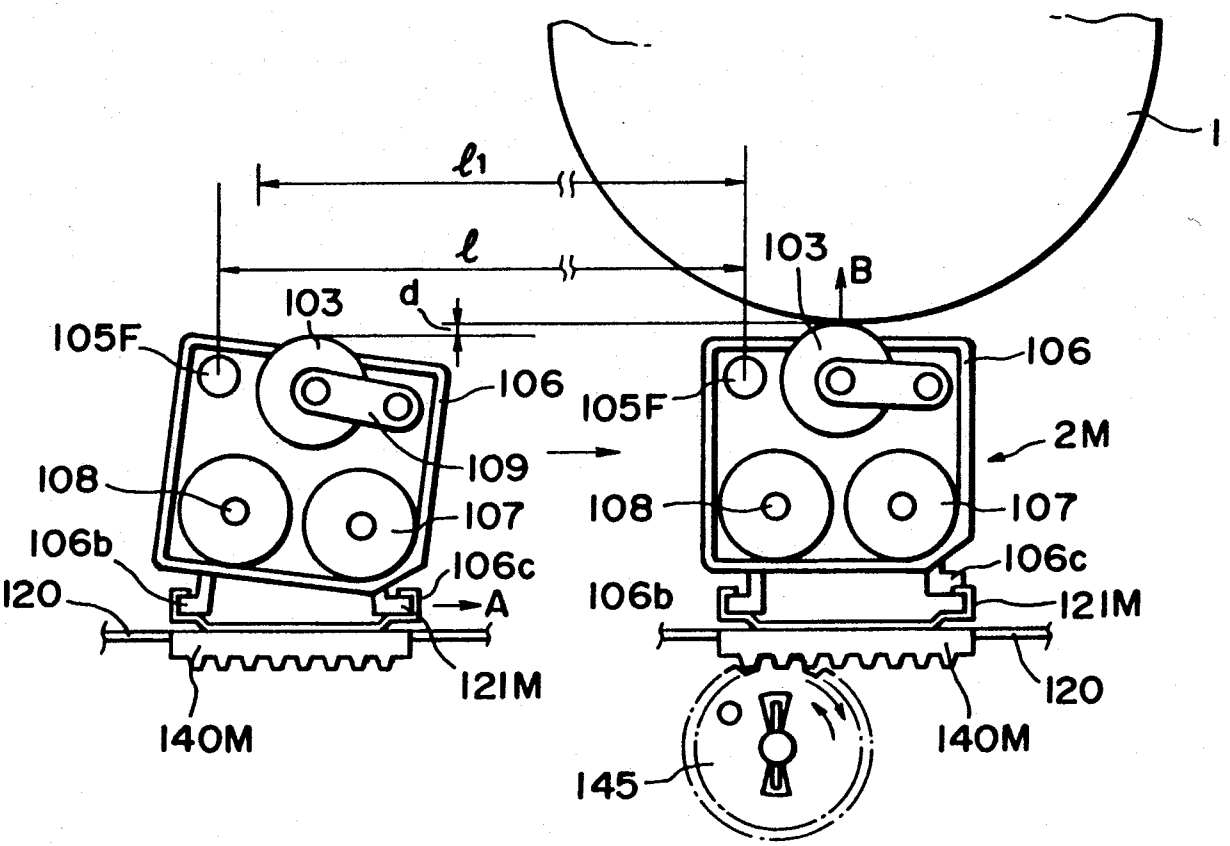

Referring to FIG. 24, the home position of the developing device is the position where the magenta developing unit 2M is at a left side from right below the center of the photosensitive drum 1, as seen from the front side.

When the copy button is depressed in order to start the copy operation, the microprocessor unit (MPU) for controlling the operation of the main assembly of the copying machine supplies a signal to a pulse generator of the stepping motor 132 for driving the carriage 120 to move the carriage 120 at a predetermined speed until the developing sleeve 102 of the magenta developing unit reaches a position right below the photosensitive drum 1.

Together with the movement of the carriage 120, the magenta developing unit 2M is raised toward the photosensitive drum 1. The raising operation will be described in detail.

In FIG. 21, the rack 141 and the clutch gear 144 are in meshing engagement when the carriage 120 is at its home position. Immediately before the carriage 120 starts its movement, the clutch gear 144 is shifted to its engagement position, and therefore, the rotational shaft 142 and the gear 145 rotate together with the movement of the carriage. During the carriage movement, the rack 140 fixed on the bottom of the slide guide 121 is brought into meshing engagement with the rotating gear 145. Since the number of teeth Z144 of the clutch gear 144, as described in the foregoing, is smaller than the number of teeth Z145 of the gear 145, the clutch gear 144 rotates on the pitch circle by $l_1$ when the carriage 120 moves through the distance $l_1$, where $l_1$ is a distance at which the rack 140 starts to engage with the gear 145 ($l_1 < l$). Converting this to a rotational angle of the rotational shaft 142, $$\alpha = l_1 / r144 \text{ (rad)}$$

where r144 is a radius of pitch circle of the clutch gear 144.

Therefore, the rotation circular length on the pitch circle of the gear 145, that is, the moving distance $l_2$ of the slide guide 121M integral with the rack 140 meshed with the gear 145 is $$\begin{aligned} l_2 &= \alpha \times r145 \\ &= l_1 \times (r145)/(r144) \end{aligned}$$

where r145 is a radius of pitch circle of the gear 145.

Here, since Z145 > Z144, that is, r145 > r144, the distances $l_1$ and $l_2$ satisfy $l_2 > l_1$. In other words, during the period in which the movable carriage 120 moves through the distance $l_1$, the slide guide 121M slides relative to the carriage 120 by the distance ($l_2 - l_1$). By the sliding movement of the slide guide 121M relative to the carriage 120 by the distance ($l_2 - l_1$) in the direction of the carriage 120 movement, the slide guide 121M, as shown in FIG. 24, pushes the leg 106*b* of the pivotable developing unit 2M in the direction A about pivots 105F and 105R on the carriage 120.

As a result, the magenta developing unit 2M is raised in the direction B during the movement of the carriage 120, and is stopped at the developing position which is close to the photosensitive drum 1 right below the photosensitive drum 1. During the raising action, the leg 106*c* of the developer container 106 moves away from the slide guide 121M as shown in the Figure. To permit this, as shown in FIG. 20, a part of the slide guide 121M is cut away to provide a cut-away portion 121M' at a position corresponding to the leg 106C.

The spacer roller 103, as shown in FIG. 24, is urged to the photosensitive drum 1 with predetermined force. To accomplish this, the raising distance of the developing unit 2M in the detection B is $d+\alpha$ ($\alpha$: positive), where d is a distance between the spacer roller 103 and the surface of the photosensitive drum at the home position. The numbers of the gears 145 and 144 are properly determined so as to accomplish this raising distance.

When the developing unit 2M is urged to the photosensitive drum through the roller 103 right below the photosensitive drum 1, it receives from the photosensitive drum 1 reaction force corresponding to the distance $\alpha$, in addition to the weight of the developing unit. The resultant force tends to rotate the developing unit 2M in the clockwise direction about the rotational pivots 105F and 105R. Therefore, the slide guide 121M is pushed leftwardly (opposite from the direction A) by the leg 106*b* of the developer container. Therefore, the rack 140M meshed with the slide guide 121M tends to rotate the gear 145 in the counterclockwise direction. The gear 145, as described hereinbefore, is normally urged in direction D by the coil spring 147 (FIG. 21), and therefore, the gear 145 rotates in the sector parallel pin groove 145*b* until the reaction force from the photosensitive drum 1 balances with the urging force by the coil spring.

The coil spring wire diameter and the number of windings thereof are so determined that the reaction force from the photosensitive drum 1, that is, the urging force of the roller 103 to the photosensitive drum 1 is a predetermined level. The rotational shaft 142 is connected with the stepping motor 132 through the clutch gear 143, the rack 141 and the rack 131. Therefore, the self-retaining force of the stepping motor 132 acts on the rotational shaft 142, whereby the carriage is correctly movable without influence of the rotation of the gear 145.

In the foregoing, the spacer roller 103 is contacted to the photosensitive drum 1. One of alternative structures is such that when the developing unit 101M is raised, the spacer roller 103, as shown in FIG. 19 is a urged with a predetermined force to abutting members 71 and 72 corresponding to the surface of the photosensitive drum 1, so that the developing sleeve 102 is closely disposed with a predetermined gap from the photosensitive drum 1.

FIG. 19 shows a sectional view of the main assembly of the copying apparatus, wherein the abutting member 72 is fixedly mounted to the rear frame 50 of the main assembly, whereas the abutting member 71 is fixedly mounted to a centering member 70 for the photosensitive drum 1 which is detachably mountable to a front frame 73. Under this state, the clutch gear 153M is energized at the predetermined timing, and therefore, the developing sleeve 102 is driven by the DC motor 125 through a driving system shown in the Figure so as to visualize the latent image on the photosensitive drum 1.

Even if the developing unit 2M is raised about pivots 105F and 105R, it can always receive the driving force from the motor during the raising action, since the gear 157 for transmitting the driving force to the sleeve gear 104 is coaxial with the pivots 105F and 105R. Therefore, according to this embodiment, the timing at which the developing sleeve 102 is driven can be determined irrespective of the raising action.

When the magenta color development process is completed by the above described steps, the clutch gears 144 (FIG. 21) and 153M (FIG. 10) are shifted to the disengaging positions. By this, the rotational shaft 142 becomes freely rotatable. Therefore, the gear 146 which is integral with this gear becomes also freely rotatable. Accordingly, as shown in FIG. 24, the slide guide 121 is urged back leftwardly by the leg 106*b* of the developer container 106 due to the reaction force from the photosensitive drum 1 and the weight of the developing unit 2M, whereby the developing unit 2M returns to the lower position shown in FIG. 24 to be away from the photosensitive drum 1.

Then, when the stepping motor 132 rotates through a predetermined amount, the clutch gear 144 is actuated, by which the cyan developing unit 101C is raised at a position right below the photosensitive drum. In addition, the clutch gear 153C (FIG. 11) is actuated to rotate the developing sleeve 102C for the cyan color to perform the developing operation for the cyan color.

Subsequently, the developing operation for the yellow and black colors are completed, and the visualized color images are superposedly transferred onto one transfer sheet. Then, the transfer sheet is separated from the transfer drum 5 by the separation charger 8 and the separation pawl 8'. It is then subjected to the image fixing operation of the fixing device 20, and is discharged to the discharge tray 23, thus completing the copying operation.

When the movable carriage 120 returns to its home position after the multi-color development is completed, the clutch gear 144 is maintained in the disengaging position, and therefore, the developing unit is not raised toward the photosensitive drum 1. Thus, during its returning operation, unnecessary toner is prevented from being deposited on the photosensitive drum from the developing sleeve, which is advantageous.

In this embodiment, in order to maintain the developing unit at the developing operation relative to the photosensitive drum, that is, to maintain the raised position, the retaining force of the stepping motor is used. In order to further ensure the maintenance, an arm rotatably supported on the main assembly may be engaged with the movable carriage by a driving source such as a solenoid at a predetermined timing.

Figure 23:
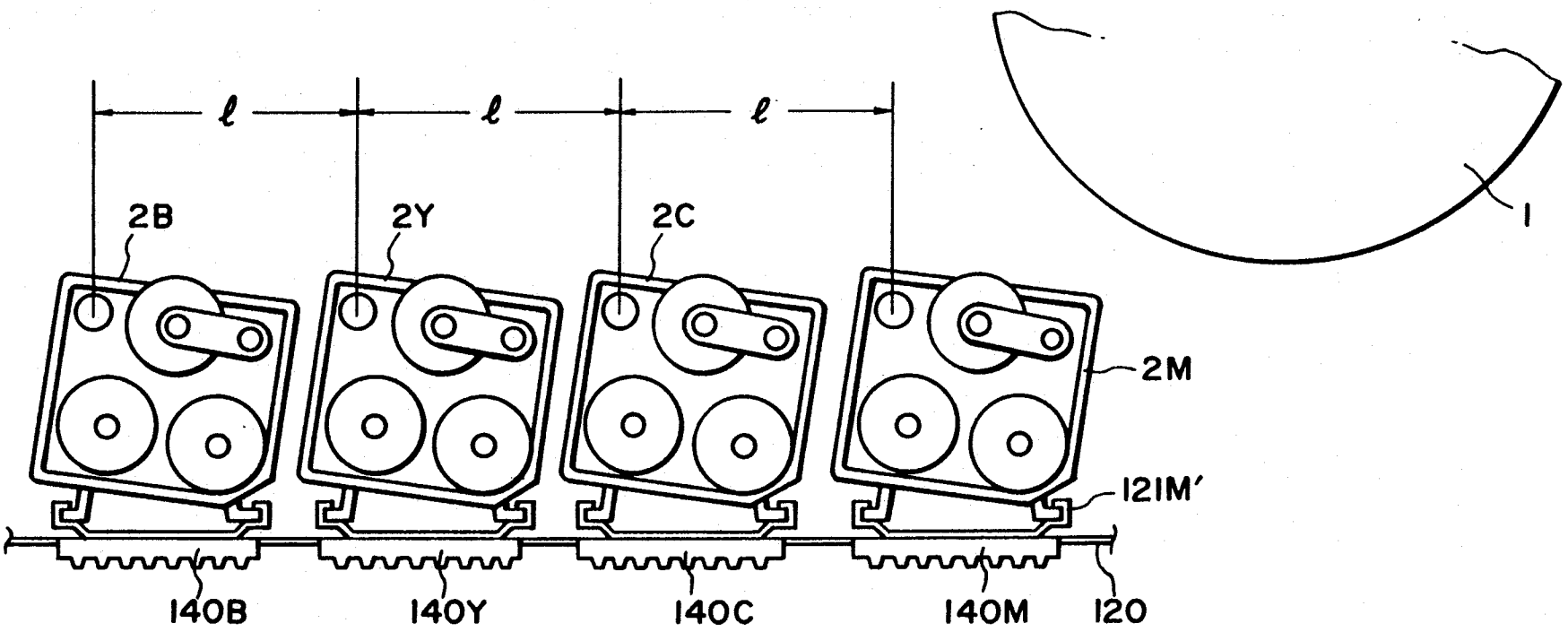
FIGS. 23 and 24 are sectional views illustrating operation of the developing apparatus.

In the structure shown in FIG. 23, the home position of the movable carriage 120, that is, the position where it waits for the start of the next printing operation after the set number of developing units carry out the developing operations, for example, after the developing operations of the four developing units are completed in the case of a full-color print, is such that all of the developing units are at one side of a position right below the photosensitive drum 1. For this reason, the moving stroke of the carriage 120 is large. This may be undesirable when the size of the image forming apparatus is to be further reduced.

In addition, each of the developing units is partly projected outwardly from the front and rear plates constituting the frame of the image forming apparatus, and therefore, the larger moving stroke of the developing device necessarily results in the larger holes in the front and rear plates to permit movement of the developing units. This is not preferable because the strength of the image forming apparatus is decreased. Furthermore, if the moving stroke of the developing device is large, the swinging stroke of the toner supply pipe of a toner supplying device which will be described in detail hereinafter and which is swung in association with movement of the developing device has to be increased, with the result of longer and heavier supply pipe with the liability that the smooth swinging operation may be obstructed.

In consideration of the above, the next embodiment is aimed at providing an image forming apparatus wherein the lateral movement stroke of the developing device is reduced, by which the size of the holes formed in the frame such as plates of the image forming apparatus is minimized, and the rigidity of the apparatus is increased to prevent the deterioration of the image quality such as blurred images attributable to the insufficient rigidity.

This embodiment is also aimed at providing an image forming apparatus in which the developing device is not required to be shifted to the left side by the pre-running distance required for raising the developing unit, by which the size of the apparatus can be reduced.

Figure 25:
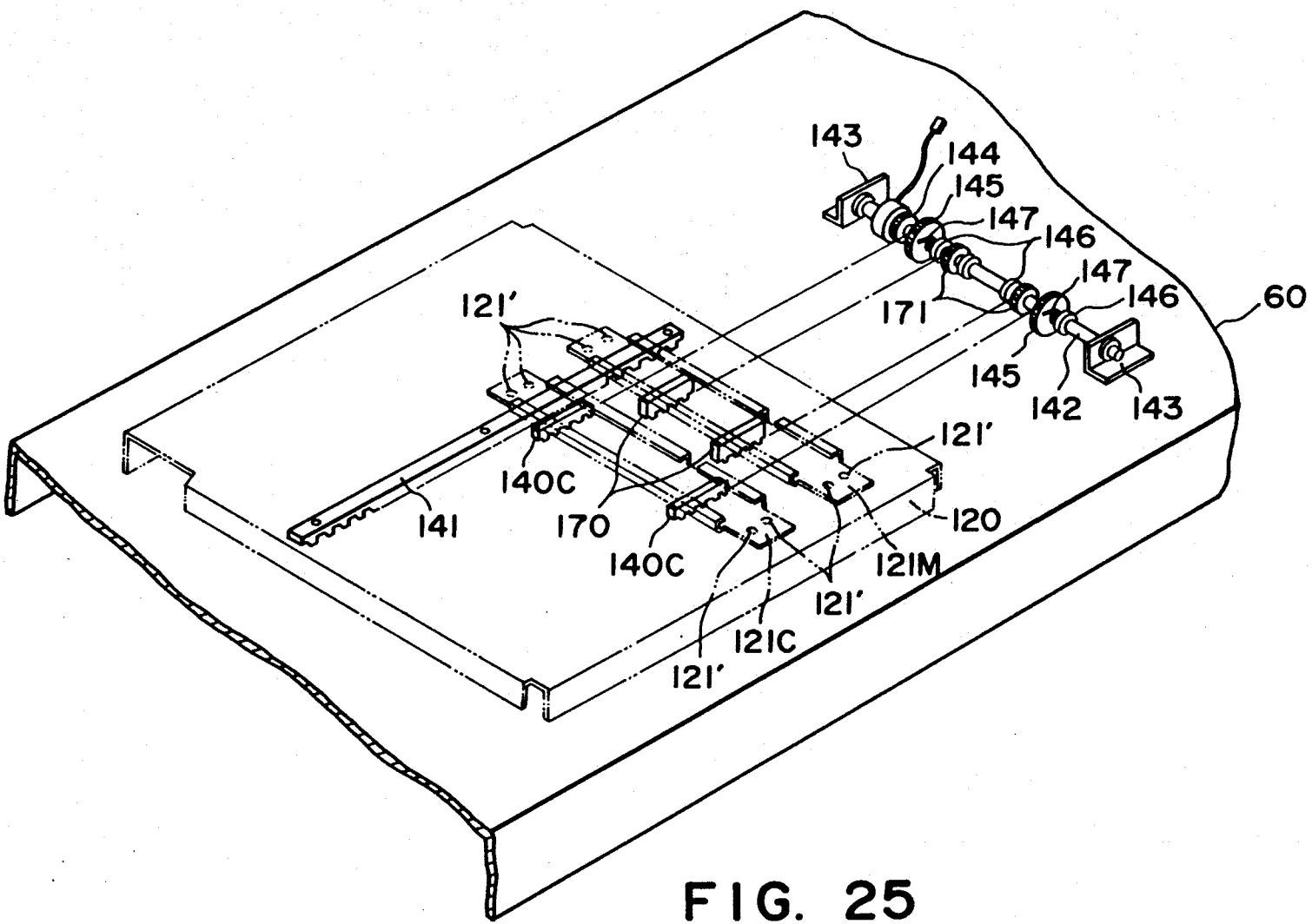
FIG. 25 is a perspective view of a developing apparatus according to a further embodiment.

FIG. 25 shows the developing unit raising mechanism of this embodiment, wherein the same reference numerals as in FIGS. 20 and 21 are assigned to the elements having the corresponding functions, and the description of these elements are omitted for simplicity.

To the backside of the slide guide 121C, a short rack 140C is fixed, and such a rack 140 is mounted to the slide guide 121Y and 121B of the developing units 101Y and 101B, respectively. These racks 140 are engageable with the gear 145, as described hereinbefore.

In this embodiment, to the backside of the slide guide 121M of the magenta color developing unit 101M, a rack 170 is secured fixed. The rotational shaft 142 is provided with a gear 171 for meshing engagement with the rack 170. The gear 171, similarly to the gear 145, is urged in the same direction as the gear 145 by a coil spring (not shown), and it is rotatable integrally with the rotational shaft 142 when an end of a sector groove formed in the inside of the gear 171 is abutted to parallel pins.

It is a possible situation that the movable carriage 120 is not at the home position when the power switch is opened, for example. In consideration of this, when the main switch of the copying apparatus is closed, the discrimination is made as to whether or not the carriage 120 is placed at its home position with the aid of a sensor 181 constituted by the light emitting element and the light receiving element fixedly mounted on the bottom plate 60 and a right blocking plate 180 adjustably mounted on the carriage 120, as shown in FIG. 20. When the carriage 120 is not at the home position, the stepping motor 130 is operated to return the carriage 120 to the home position, that is, until the light of the sensor 181 is blocked by the light blocking plate 180.

Figure 26:
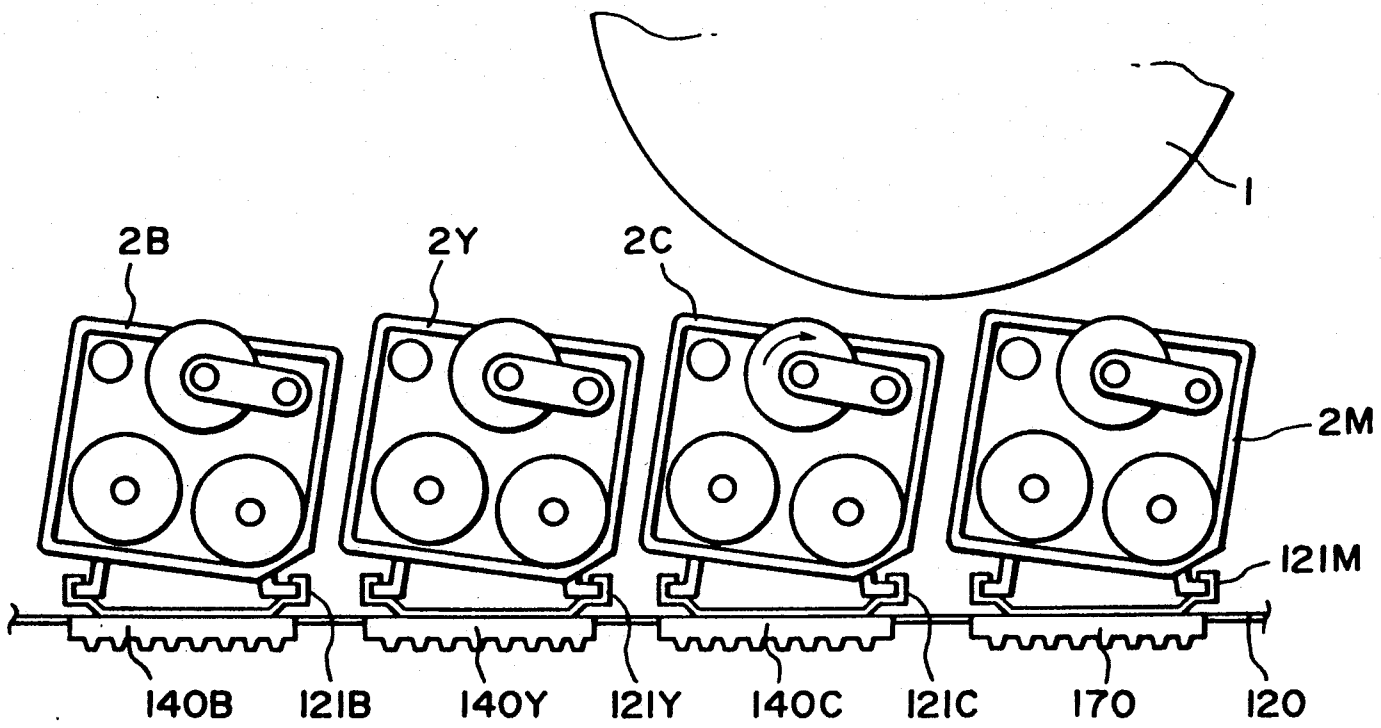
FIGS. 26 and 27 are sectional views illustrating operation of the developing apparatus.

As shown in FIG. 26, according to this embodiment, the home position of the movable carriage 120 is such that the magenta developing unit 101M is away from the position right below the axis of the photosensitive drum 1 rightwardly by the distance $l_2$, as seen from the front side. In the home position, the rack 141 and the clutch gear 144 are in meshing engagement.

When the copy button is depressed to start the copy operation, the microprocessor unit (MPU) for controlling the operation of the copying apparatus supplies a signal to a pulse generator of the stepping motor 132 for driving the carriage 120 to move the carriage 120 at a predetermined speed leftwardly until the developing sleeve 102 of the magenta developing unit 101M reaches to a position right below the photosensitive drum 1.

Together with the movement of the carriage 120, the magenta developing unit 2M is raised upwardly toward the photosensitive drum 1.

Figure 27:
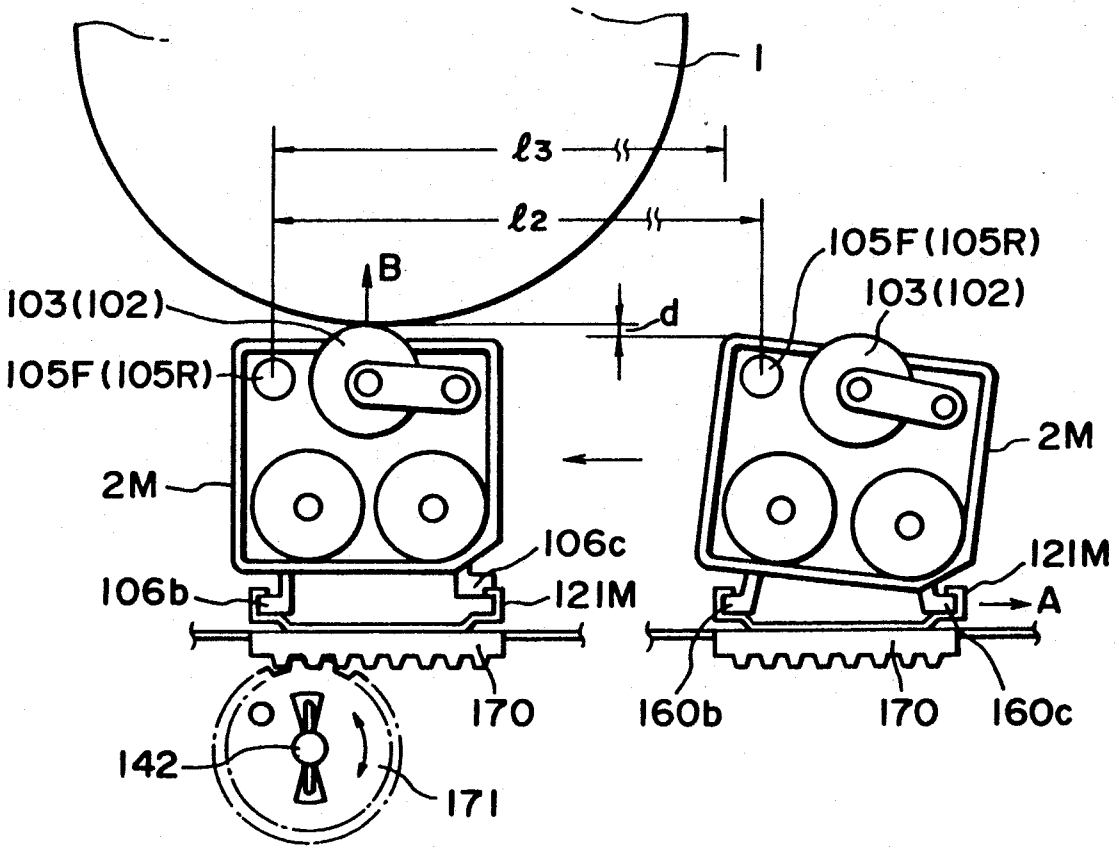

Referring to FIGS. 25 and 27, the raising operation will be described in detail.

As described in the foregoing, at the home position, the rack 141 and the clutch gear 144 are in meshing engagement. Upon start of the image forming operation, that is, the copy operation, the carriage 120 moves leftwardly. Prior to this, the clutch of the clutch gear 144 is shifted to the engaging position, and therefore, the rotational shaft 142, gear 145 and the gear 171 rotate together with the movement of the movable carriage 120.

When the movable carriage 120 moves, the rack 170 fixedly mounted to the bottom of the slide guide 121M of the magenta developing unit 101M is brought into meshing engagement with the rotating gear 171. The number of teeth Z144 of the clutch gear 144 is smaller than the number of teeth Z171 of the gear 171. Therefore, as will be understood from FIG. 27, when the movable carriage 120 moves through a distance $l_3$, the clutch gear 144 rotates through the distance $l_3$ measured on the pitch circle (where the distance $l_3$ where the rack 170 starts to engage with the gear 171 ($l_3 < l_2$).

Converting this to a rotational angle $\alpha$ of the rotational axis 142, $$\alpha = l_3/r144 \text{ (rad)}$$

where r144 is a radius of the pitch circle of the clutch gear 144.

Therefore, the rotational distance measured on the pitch circle of the gear 171, that is, the movement distance $l_4$ of the slide guide 121M integral with the rack 170 meshed with the gear 171 is $$\begin{aligned} l_4 &= \alpha \times r171 \\ &= l_3 \times (r171)/(r144) \end{aligned}$$

where r171 is a radius of the pitch circle of the gear 171.

Here, since Z171<Z144, that is, r171<r144, the distances satisfy $l_4 < l_3$.

Accordingly, during the period in which the movable carriage 120 moves through the distance $l_3$, the slide guide 121M moves relative to the movable carriage 120 by the distance ($l_3 - l_4$) in a direction opposite to the movement direction of the carriage 120. Therefore, as shown in FIG. 27, the slide guide 121M pushes the leg 106*b* of the developing unit 2M in the direction A, the developing unit 2M being rotatable on the movable carriage 120 about a pivot 105F (105R). As a result, the sleeve 102 of the magenta color developing unit 2M is raised in the direction B during the movement of the movable carriage 120, so that the spacer roller 103 is abutted to the photosensitive drum 1 or to the positioning members 71 and 72. Thus, the developing unit 2M is positioned at the developing position.

The spacer roller 103 is urged to the photosensitive drum 1 or to the members 71 and 72 with predetermined force. In order to achieve this, the amount of the raising distance of the developing unit 2M in the direction B is $d+\alpha$ ($\alpha$: positive), where d is a distance between the spacer roller 103 and the surface of the photosensitive drum 1 at its home position. The number of the teeth of the gear 171 is determined in relation to the moving distance in order to provide the raising distance.

When the developing unit 2M is positioned at the developing position, it receives from the photosensitive drum 1 or from the members 71 and 72 the reaction force corresponding to the distance $\alpha$, and the gravity force to the developing unit is added thereto. The resultant force tends to rotate the developing unit 2M in the clockwise direction about the pivots 105F and 105R. Therefore, the slide guide 121M is urged leftwardly (opposite to the direction A) by the leg 106*b* of the developer container, and therefore, the rack 170 meshed with the slide guide 121M tends to rotate the gear 171 in the counterclockwise direction. The gear 171, as described in the foregoing, is urged in the direction D by the coil spring 147 (FIG. 22), and therefore, the gear 171 is rotated in the sector parallel pin groove 145*b*, while the coil spring is compressed until the reaction force from the photosensitive drum 1 and the movement of the developing unit is balanced with the coil spring urging force.

The wire diameter and the number of windings of the coil spring 147 are so determined that the reaction force from the photosensitive drum 1 or the members 71 and 72, in other words, the urging force of the spacer roller 103 to the drum 1 or the members 71 and 72 is a predetermined level. The rotational shaft 142 is connected with the stepping motor 132 through the clutch gear 144, the rack 141 and the rack 131. Therefore, the self-retaining force of the stepping motor 132 acts on the rotational shaft 142, so that the carriage is correctly retained without influence of the rotation of the gear 171.

When the developing operation for the magenta color is completed in the manner described above, the clutch gear 144 and the clutch gear 153M are shifted to their disengaging positions. By this, the rotational shaft 142 becomes freely rotatable, and therefore, the gear 171 integral therewith also becomes freely rotatable. By this, the reaction force from the photosensitive drum 1 and the gravity force applied to the developing unit 2M urges back, that is, leftwardly the slide guide 121 through the leg 106*b* of the developer container 106, by which the developing unit 2M returns to the lower position shown in FIG. 27 (right side) so that it is away from the photosensitive drum 1.

As described in the foregoing, when the magenta developing unit 2M returns to the lower position, and is away from the photosensitive drum 1, the movable carriage 120 starts to move rightwardly, and as shown in FIG. 28, the cyan developing unit and the other subsequent developing units are sequentially raised in association with the movement of the movable carriage. The operation in this respect is the same as those described in conjunction with FIGS. 21 and 24, and therefore, the detailed description is omitted.

After the desired number of developing operations by the developing units are completed, the carriage 120 is returned to the home position. During this operation, the clutch gear 144 is shifted to the disengaging position, and therefore, the shaft 142 does not rotate. Thus, each of the developing units is not raised, so that the unnecessary deposition of the developer to the drum can be prevented.

In order to obtain images having stabilized image density, it is desired that the sleeve and/or the screws 107 and 108 of the developing unit is driven to continue to stir the developer when the developing unit is not at the developing position, further preferably at all times. Particularly when the developer is a two component developer containing toner and carrier particles, the developer is desired to be stirred during the non-developing operation prior to the developing operation in order to toner and the carrier particles are rubbed each other to provide the toner with sufficient triboelectric charge. When the two component developer is used, the toner density is detected and is controlled to be maintained within a proper range in some case. In this case, it is desirable that the developer is stirred when the developing operation is not performed, in order to correctly detect the toner content and to correctly supply the toner. In order to solve this problem, the driving force for the developing unit driving source is transmitted to the developing unit which is not at the developing position. In the foregoing embodiment, a gear 157 is provided which is coaxial with the swinging axis 150F, 150R of the developing unit. The DC motor 125 for driving the sleeve 102 and the screws 107 and 108 through the gear 157 and is fixedly mounted on the movable carriage 120 on which the developing units are carried, so that the driving force is transmitted to each of the developing units. Therefore, controlling the clutch gear 153 between the engaging position and the disengaging position, the driving force can be transmitted to required developing units when they are away from the developing position as well as when they are at the developing position.

In the developing device 100 of a reciprocably movable type, the developer in the developing unit is swung by the reciprocal movement and the rotational movement about the axes 105R and 105F toward the photosensitive drum 1, and therefore, the developer can be stirred even when the developing operation is not performed, which contributes to the correct toner content detection and the correct control of the toner content.

According to this embodiment, the timing of the cutting of the magnetic brush on the developing sleeve (FIG. 6) and the timing of the magnetic brush formation (FIG. 5) can be freely controlled.

The developing unit 2 rotates about the pivot 105 to approach the photosensitive drum 1, until the spacer roller 103 is abutted to the photosensitive drum 1 or to the abutting member 71 and 72 in order to assure the predetermined gap between the developing sleeve 102 and the photosensitive drum 1 surface. If there is an erected magnetic brush on the developing sleeve, the developer on the developing sleeve can be deposited onto the photosensitive drum. The toner deposition to the photosensitive drum occurs before the transfer sheet is fed to the photosensitive drum, and therefore it is not transferred onto the transfer sheet but is transferred to the transfer drum with the result that the transfer sheet is contaminated at its backside, or that the transfer sheet is not properly attracted on the transfer drum.

It is conventional that those problems are avoided by separating the transfer drum from the photosensitive drum at predetermined timing. However, this results in complicated and bulky apparatus.

According to this embodiment, it is possible that, as shown in FIG. 6, the developing sleeve 102 is rotated in the brush removing direction at predetermined timing to provide non-brush state, and thereafter, the developing unit 101 is moved toward the photosensitive drum 1, and therefore, the above problems can be solved without necessity of the complicated and bulky structure of the apparatus. After the developing unit 101 is disposed at the developing position, the developing sleeve 102 is rotated to provide the brush formed state, as shown in FIG. 5.

The brush removing operation is performed utilizing the time period in which the movable carriage 120 returns to the home position after completion of the developing operations by the respective developing units. According to this embodiment, any developing unit can be driven by the driving source at all times, and therefore, they can be driven in a desired period before the movable carriage 120 returns to the home position.

According to this embodiment, each one, each two or all of the sleeves of the developing units can be rotated in the brush removing direction, simultaneously. The driving method for the brush removal can be freely selected. The driving method may be determined on the basis of the image formation process speed of the apparatus and the capacity of the driving source.

As to the timing at which the brush formation rotation starts immediately before the start of the developing operation, if it is started after the movement of the developing sleeve toward the photosensitive drum is completed, the developing operation can not be started before the developer reaches the position where the sleeve is close to the drum, and it is not preferable from the standpoint of the image formation speed.

According to this embodiment, the driving force is transmitted to the gear 104 for the developing sleeve 102 through the gear 157 disposed coaxially with the developing unit pivot 105R, and therefore, the drive transmission to the developing sleeve is possible during the rotation for moving the developing unit toward the photosensitive drum. Therefore, in this embodiment, the brush formation timing on the developing sleeve can be selected as desired.

As shown in FIG. 11, in this embodiment, the gear 157 coaxial with the pivot of the developing unit 101 rotates in the direction b, and the gear 104 of the developing sleeve rotate in the direction a. Therefore, in the portion of engagement between the gear 104 and the gear 157, the force is produced to the gear 104 to rotate the developing unit upwardly, that is, toward the photosensitive drum. Therefore, during the developing operation, the force is contributable to retain the developing unit at the developing position close to the photosensitive drum, so that the developing unit is stably maintained in the developing operation. Thus, according to the structure of this embodiment, the positional relation between the developing sleeve and the photosensitive drum does not change during the developing operation, and therefore, the image qualities are stabilized.

In consideration of the possibility that the developer is deteriorated due to a number of image forming operations, a reversible DC motor is used for the developing unit driving motor 125, by which the motor is reversely rotated (opposite to the direction during the developing operation) irrespective of the current position of the developing unit, so that the deteriorated developer in the developing unit can be discharged externally from the developing unit along the screw 107. As described hereinbefore, it is possible to rotate the developing sleeves of all of the developing units, simultaneously, by which the developers in all of the developing units can be simultaneously collected for a short period of time. This is advantageous from the standpoint of the apparatus maintenance.

In the foregoing embodiment, the developing device is below the photosensitive drum, and is reciprocally movable in a horizontal plane, but the reciprocally movable developing device is not limited to such a device, but it is a possible alternative that it is reciprocable in a vertical direction or another non-horizontal direction in facing relation with the photosensitive drum.

As will be understood from the foregoing, according to the embodiments, the conveyance of the developing unit carrying carriage and the raising of the developing unit can be performed by a single motor (stepping motor), for example, by which the size, cost and the noise can be minimized, and in addition, a highly reliable image forming apparatus with stabilized operation can be performed.

In the foregoing embodiments, the image forming machines are in the form of a full-color electrophotographic copying apparatus, but the present invention is applicable to a monochromatic or multicolor copying machine if it is provided with two or more developing units.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a movable image bearing member;

means for forming electrostatic latent images on said image bearing member;

a plurality of developing units for developing the electrostatic latent images using developers having different colors;

supporting means for supporting said plural developing units, said supporting means being rectilinearly movable along a predetermined path;

driving means for moving said supporting means along the path; and developing unit moving means for moving, using force resulting from rectilinear movement of said supporting means, a selected one of said developing units in a direction crossing with a direction of the rectilinear movement of said supporting means to a developing position in interrelation with the rectilinear movement of said supporting means, wherein during movement of said supporting means along the predetermined path, the selected developing unit moves in a direction crossing with a movement direction of the linear movement of said supporting means.

2. An apparatus according to claim 1, wherein said developing unit moving means includes a rack fixed to said supporting means, a gear engageable with the rack and rotatable at a fixed position in association with movement of said supporting means, and a movable acting member for moving said developing unit to the developing position using rotational force of the gear.

3. An apparatus according to claim 2, wherein in a driving force transmission path between the gear and the acting member, there is a clutch for selectively transmitting the driving force to the acting member.

4. An apparatus according to claim 1, 2 or 3, wherein said image bearing member is in the form of a rotatable drum, and said supporting means is laterally reciprocable below said image bearing member, said apparatus further comprising image transfer means for transferring a developed image formed on said image bearing member at an image transfer position above a horizontal plane including a central axis of said image bearing member, wherein said image transfer means has a rotatable member to permit superposed transfers of the developed images at the image transfer position.

5. An image forming apparatus, comprising:

a movable image bearing member;

means for forming electrostatic latent images on said image bearing member;

at least first and second developing units for developing the electrostatic latent images using developers having different colors;

supporting means for supporting said first and second developing units, said supporting means being rectilinearly movable along a predetermined path;

driving means for reciprocally moving said supporting means along the path;

developing unit moving means for moving a selected one of said developing units to a developing position by moving said developing unit in a direction crossing with a direction of the rectilinear movement using a moving force used for moving said supporting means, wherein when said supporting means is at its home position, said first developing unit is positioned at one side of a developing position and said second developing unit is positioned at an opposite side, wherein said image bearing member is in the form of a rotatable drum, and said supporting means is laterally reciprocable below said image bearing member; and transfer means for transferring a developed image formed on said image bearing member at an image transfer position above a horizontal plane including a central axis of said image bearing member, wherein said image transfer means has a rotatable member to permit superposed transfers of the developed images at the image transfer position.

6. An apparatus according to claim 5, wherein said developing unit moving means includes a rack fixed to in said supporting means, a gear engageable with the rack and rotatable at a fixed position in association with movement of said supporting means, and a movable acting member for moving said developing unit to the developing position using rotational force of the gear.

7. An apparatus according to claim 6, wherein in a driving force transmission path between the gear and the acting member, there is clutch for selectively transmitting the driving force to the acting member.

8. An image forming apparatus, comprising:

a movable image bearing member;

means for forming electrostatic latent images on said image bearing member;

a plurality of developing units for developing the electrostatic latent images using developers having different colors, each of said developing units having different colors, each of said developing units having a movable developer carrying member for carrying the developer to supply it to said image bearing member;

supporting means for supporting said plural developing units, said supporting means being rectilinearly movable along a predetermined path;

first driving means for driving said supporting means to move it along the path;

second driving means for driving said movable developer carrying member of each of said developing units, said second driving means including a driving motor and drive transmission means for transmitting a driving force of the driving motor to each of said movable developer carrying members, and being supported on said supporting means; and developing unit moving means for moving, using force resulting from rectilinear movement of said supporting means, a selected one of said developing units to a developing position by moving said developing unit in a direction crossing with a direction of the rectilinear movement of said supporting means to a developing position in interrelation with the rectilinear movement of said supporting means.

9. An apparatus according to claim 8, wherein each of said developing units is supported on said supporting means for swinging movement about an axis, and is moved to a developing position by said developing unit moving means, wherein the driving force transmitting means of said second driving means includes a gear train coaxial with the axis.

10. An apparatus according to claim 9, wherein said developing unit moving means includes a rack fixed to said supporting means, a second gear engageable with the rack and rotatable at a fixed position in association with movement of said supporting means, and a movable acting member for moving said developing unit to the developing position using rotational force of the gear.

11. An apparatus according to claim 10, wherein in a driving force transmission path between the second gear and the acting member, there is a clutch for selectively transmitting the driving force to the acting member.

12. An apparatus according to claim 8, 9, 10 or 11, wherein said image bearing member is in the form of a rotatable drum, and said supporting means is laterally reciprocable below said image bearing member, said apparatus further comprising image transfer means for transferring a developed image formed on said image bearing member at an image transfer position above a horizontal plane including a central axis of said image bearing member, wherein said image transfer means has a rotatable member to permit superposed transfers of the developed images at the image transfer position.

13. An apparatus according to claim 4, wherein said rotatable member carries a final image bearing member and repeatedly presents the final image bearing member to the image transfer position.

14. An apparatus according to claim 5, wherein said rotatable member carries a final image bearing member and repeatedly presents the final image bearing member to the image transfer position.

15. An apparatus according to claim 12, wherein said rotatable member carries a final image bearing member and repeatedly presents the final image bearing member to the image transfer position.

16. An image forming apparatus, comprising:

a movable image bearing member;

means for forming electrostatic latent images on said image bearing member;

a plurality of developing units for developing the electrostatic latent images using developers having different colors;

supporting means for supporting said plural developing units, said supporting means being rectilinearly movable along a predetermined path;

driving means for moving said supporting means along the path; and developing unit moving means for moving, using force resulting from rectilinear movement of said supporting means, a selected one of said developing units in a direction crossing with a direction of the rectilinear movement of said supporting means to a developing position in interrelation with the rectilinear movement of said supporting means, wherein said selected one of said developing units is supported by said supporting means even in the developing position.

17. An image forming apparatus, comprising:

a movable image bearing member;

means for forming electrostatic latent images on said image bearing member;

a plurality of developing units for developing the electrostatic latent images using developers having different colors, each of said developing units having a movable developer carrying member for carrying the developer to supply it to said image bearing member;

supporting means for supporting said plural developing units, said supporting means being rectilinearly movable along a predetermined path;

first driving means for driving said supporting means to move it along the path;

second driving means for driving the developer carrying member of each of said developing units, said second driving means including a driving motor and drive transmission means transmission means for transmitting a driving force of said driving motor to each of said developer carrying members, and being supported on said supporting means; and developing unit moving means for moving, using force resulting from rectilinear movement of said supporting means, a selected one of said developing units in a direction crossing with a direction of the rectilinear movement of said supporting means to a developing position in interrelation with the rectilinear movement of said supporting means, wherein said selected one of said developing units is supported by said supporting means even in the developing position.

18. An apparatus according to claim 16 or 17, wherein each said developing unit is supported on said supporting means for swinging movement about an axis.

19. An apparatus according to claim 18, wherein a selected one of said developing units is placed at the developing position by swinging motion about the axis.

20. An apparatus according to claim 1, 5, 8, 16 or 17, wherein said plurality of developing units contain yellow, magenta, cyan and black developers, respectively.

21. An apparatus according to claim 1, 5, 8, 16, or 17 wherein the rectilinear movement is horizontal.

22. An image forming apparatus, comprising:

a movable image bearing member;

means for forming electrostatic latent images on said image bearing member;

a plurality of developing units for developing the electrostatic latent images using developers having different colors;

supporting means for supporting said plurality developing units, said supporting means being rectilinearly movable along a predetermined path;

driving means for moving said supporting means along the path;

developing unit moving means for moving a selected one of said developing units to a developing position by moving said developing unit in a direction crossing with a direction of the rectilinear movement using a moving force used for moving said supporting means, wherein said image bearing member is in the form of a rotatable drum, and said supporting means is laterally reciprocable below said image bearing member; and image transfer means for transferring a developed image formed on said image bearing member at an image transfer position above a horizontal plane including a central axis of said image bearing member, wherein said image transfer means has a rotatable member to permit superposed transfers of the developed images at the image transfer position.

23. An image forming apparatus, comprising:

a movable image bearing member;

means for forming electrostatic latent images on said image bearing member;

a plurality of developing units for developing the electrostatic latent images using developers having different colors, each of said developing units having a movable developer carrying member for carrying the developer to supply it to said image bearing member;

supporting means for supporting said plural developing units, said supporting means being rectilinearly movable along a predetermined path;

first driving means for driving said supporting means to move it along the path;

second driving means for driving said developer carrying member of each of said developing units, said second driving means including a driving motor and drive transmission means for transmitting a driving force of the driving motor to each of said developer carrying members, and being supported on said supporting means;

developing unit moving means for moving a selected one of said developing units to a developing position by moving said developing unit in a direction crossing with a direction of the rectilinear movement using a moving force used for moving said supporting means, wherein said image bearing member is in the form of a rotatable drum, and said supporting means is laterally reciprocable below said image bearing member; and image transfer means for transferring a developed image formed on said image bearing member at an image transfer position above a horizontal plane including a central axis of said image bearing member, wherein said image transfer means has a rotatable member to permit superposed transfers of the developed images at the image transfer position.

* * * * *

UNITED STATES PATENT AND TRADEMARK OFFICE
CERTIFICATE OF CORRECTION

PATENT NO. : 5,243,395

DATED : September 7, 1993

INVENTOR(S) : KOIKE ET AL.

It is certified that error appears in the above-identified patent and that said Letters Patent is hereby corrected as shown below:

On the Title Page, Item [56], Col. 2, line 6:

U.S. Patent Documents, insert
--4,939,548 7/1990 Yamada et al.
4,941,018 7/1990 Kasamura et al.--

Column 2

Line 8, "is" should read --are--.

Column 6

Line 11, "charger 8" should read --charger 7--.
Line 25, "a" should read --the--.

Column 10

Line 7, "121C')" should read --121B')--.

Column 13

Line 2, "(Z1 x Z3) / 2 x Z2," should read --(Z1 X Z3) / (2 X Z2),--.

Line 62, "when 1/2." should read --when the movable carriage 120 moves through the distance 1/2.--.

UNITED STATES PATENT AND TRADEMARK OFFICE

CERTIFICATE OF CORRECTION

PATENT NO. : 5,243,395

DATED : September 7, 1993

INVENTOR(S) : KOIKE ET AL.

It is certified that error appears in the above-identified patent and that said Letters Patent is hereby corrected as shown below:

Column 16

Line 18, "detection B" should read --direction B--.
Line 56, "a" should be deleted.

Column 19

Line 54, "$=l_3$ x (r171)/(r144)" should read --$=l_3$ x(r171/r144)--.

Column 21

Line 20, "in order to" should read --so that the--.
Line 21, before "each" insert --against--.

UNITED STATES PATENT AND TRADEMARK OFFICE

CERTIFICATE OF CORRECTION

PATENT NO. : 5,243,395

DATED : September 7, 1993

INVENTOR(S) : Koike, et al

It is certified that error appears in the above-indentified patent and that said Letters Patent is hereby corrected as shown below:

Column 24

Line 55, "in" should be deleted.

Line 63, "is" should read --is a--.

Column 26

Line 43, "transmission means" (second occurrence) should be deleted.

Signed and Sealed this

Twelfth Day of July, 1994

Bruce Lehman

*Attest:*

BRUCE LEHMAN

*Attesting Officer*

*Commissioner of Patents and Trademarks*